US005392935A

United States Patent [19]

Kazama et al.

[11] Patent Number: 5,392,935

[45] Date of Patent: Feb. 28, 1995

[54] CONTROL SYSTEM FOR CABLE CRANE

[75] Inventors: Keizo Kazama, Hirakata; Kiichiro Tanaka, Tokorozawa; Eiji Takahashi, Ikoma; Michio Nakao, Yokohama, all of Japan

[73] Assignee: Obayashi Corporation, Osaka, Japan

[21] Appl. No.: 105,979

[22] Filed: Aug. 13, 1993

[30] Foreign Application Priority Data

| | | | |
|---|---|---|---|
| Oct. 6, 1992 | [JP] | Japan | 4-267487 |
| Oct. 6, 1992 | [JP] | Japan | 4-267488 |
| Oct. 6, 1992 | [JP] | Japan | 4-267489 |
| Oct. 6, 1992 | [JP] | Japan | 4-267490 |
| Nov. 26, 1992 | [JP] | Japan | 4-317315 |

[51] Int. Cl.[6] ..... B66C 21/00

[52] U.S. Cl. ..... 212/155; 212/87; 212/94; 212/153; 414/21

[58] Field of Search ..... 212/147, 153, 155, 79, 212/80, 81, 87, 88, 89, 90, 91, 92, 93, 94, 95, 96, 97; 414/21, 137.9, 138.1, 138.2, 138.3, 138.4

[56] References Cited

FOREIGN PATENT DOCUMENTS

| | | | |
|---|---|---|---|
| 256961 | 2/1988 | European Pat. Off. | 414/137.9 |
| 64785 | 5/1977 | Japan | 414/138.2 |
| 63-70306 | 3/1988 | Japan . | |
| 3-3604 | 1/1991 | Japan . | |
| 4-100152 | 4/1992 | Japan . | |

*Primary Examiner*—Michael S. Huppert

*Assistant Examiner*—Thomas J. Brahan

*Attorney, Agent, or Firm*—Wenderoth, Lind & Ponack

[57] ABSTRACT

A cable crane system includes a main cable stretched between two points, a transverse trolley traveling along the main cable, a traction cable for driving the trolley, a bucket hung by a hanging cable, a transverse winch for driving the traction cable for driving the trolley between a transportation start position and a transportation end position, a vertical winch for retracting and extracting the hanging cable for lifting the bucket up and down, and driving means for the transverse and vertical winches. A control system for such cable crane system comprises means for detecting a weight of an object for transportation including the trolley and the bucket, means for detecting transverse traveling magnitude and speed of the trolley, means for detecting vertical traveling magnitude and speed of the bucket, arithmetic means for deriving a predicted value of a magnitude of deflection of the main cable on the basis of a trace of the main cable preliminarily established as a numerical model corresponding to the overall weight loaded on the main cable, detected by the weight detecting means, a coordinate of a starting point and target destination point of the trolley, and transverse traveling magnitude of the trolley and vertical traveling magnitude of the bucket, and means for controlling the driving means on the basis of the results of arithmetic operation of the arithmetic means.

35 Claims, 22 Drawing Sheets

(a)

(b)

(c)

(a)

(b)

(c)

(a)
CABLE LENGTH (b)
TROLLEY SPEED (c)
BUCKET SWING ANGLE (d)
BUCKET SWING DIRECTION (e)
OFFSET FROM DECELERATION INITIATING POSITION (f)
SWING (AFTER STOPPING OR AFTER ACCELERATING)

(g)
OFFSET OF STOPPING POSITION

| SWING ANGLE / SWING DIRECTION / TROLLEY SPEED | -VB | -B | -M | -S | -VS | Z |
|---|---|---|---|---|---|---|
| | + | + | + | + | + | + |
| 1 | VB | B | M | S | V | M |
| 1.5 | B | M | S | VS | M | B |
| 2 | M | S | VS | M | B | VB |
| 2.5 | M | VS | S | B | VB | VB |

(VB:VeryBig B:Big M:Medium S:Small VS:Very Small Z:Zero)

FIG. 13

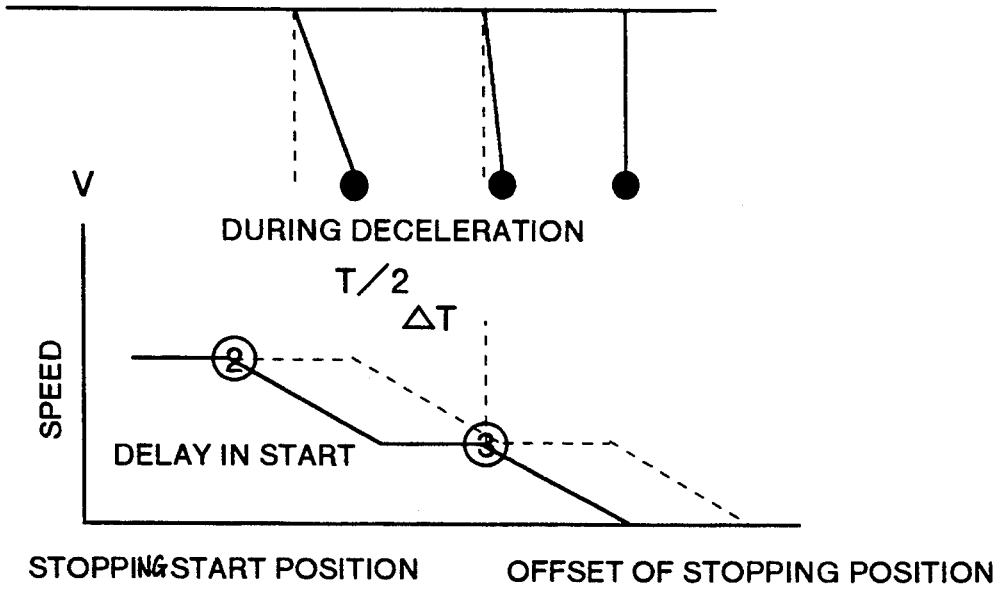

FIG. 14 (a)

AMPLITUDE OF SWING AFTER DECELERATION : FOR ALL R

| SWING ANGLE / SWING DIRECTION / TROLLEY SPEED | -M | | -S | | -VS | | Z | | VS | | S | | M | |
|---|---|---|---|---|---|---|---|---|---|---|---|---|---|---|
| | - | + | - | + | - | + | - | + | - | + | - | + | - | + |
| 2 | VB | B | VB | M | B | S | VS | VS | S | M | M | B | B | VB |
| 3 | VB | B | VB | M | B | S | VS | VS | S | M | M | B | B | VB |
| 4 | VB | VB | VB | B | VB | M | VS | VS | M | B | B | VB | VB | VB |
| 5 | VB | VB | VB | B | VB | M | VB | VS | M | B | B | VB | VB | VB |

(VB:VeryBig B:Big M:Medium S:Small Z:Zero)

FIG. 14 (b)

OFFSET OF DECELERATION

| DISTANCE / SPEED | - VF | - F | - M | - C | - Z | + Z | + C | + M | + F | + VF |
|---|---|---|---|---|---|---|---|---|---|---|
| 2 | VB | B | M | S | Z | Z | S | M | B | VB |
| 3 | VB | VB | B | M | Z | Z | M | B | VB | VB |
| 4 | VB | VB | VB | B | Z | Z | B | VB | VB | VB |
| 5 | VB | VB | VB | B | Z | Z | B | VB | VB | VB |

FIG. 15 (a)

SWING AMPLITUDE AFTER STOPPING : R = S

| TROLLEY SPEED \ SWING ANGLE / SWING DIRECTION | Z | VS | S | M | B | VB |
|---|---|---|---|---|---|---|
| | - | - | - | - | - | - |
| 1 | M | VS | S | M | B | VB |
| 1.5 | B | M | VS | S | M | B |
| 2 | VB | B | M | VS | S | M |
| 2.5 | VB | B | M | S | VS | M |

FIG. 15 (b)

SWING AMPLITUDE AFTER STOPPING : R = M

| TROLLEY SPEED \ SWING ANGLE / SWING DIRECTION | Z | VS | S | M | B | VB |
|---|---|---|---|---|---|---|
| | - | - | - | - | - | - |
| 1 | S | VS | M | M | VB | VB |
| 1.5 | M | S | VS | M | M | VB |
| 2 | B | M | S | VS | M | B |
| 2.5 | VB | B | M | S | VS | M |

FIG. 15 (c)

SWING AMPLITUDE AFTER STOPPING : R = B

| TROLLEY SPEED \ SWING ANGLE / SWING DIRECTION | Z | VS | S | M | B | VB |
|---|---|---|---|---|---|---|
| | - | - | - | - | - | - |
| 1 | M | S | VS | M | B | VB |
| 1.5 | B | M | S | VS | M | B |
| 2 | VB | B | M | S | VS | M |
| 2.5 | VB | B | B | M | S | S |

FIG. 15 (d)

SWING AMPLITUDE AFTER STOPPING : R = VB

| TROLLEY SPEED \ SWING ANGLE / SWING DIRECTION | Z | VS | S | M | B | VB |
|---|---|---|---|---|---|---|
| | - | - | - | - | - | - |
| 1 | S | VS | M | B | VB | VB |
| 1.5 | M | S | S | M | B | VB |
| 2 | B | M | VS | S | M | B |
| 2.5 | VB | B | M | VS | S | M |

(VB:VeryBig B:Big M:Medium S:Small Z:Zero)

FIG. 15 (e)

OFFSET OF STOP POSITION

| SPEED \ DISTANCE | - VF | - F | - M | - C | - Z | + Z | + C | + M | + F | + VF |
|---|---|---|---|---|---|---|---|---|---|---|
| 1 | B | M | S | S | Z | Z | S | S | M | B |
| 1.5 | B | B | M | S | Z | Z | S | M | B | B |
| 2 | VB | B | M | S | Z | Z | S | M | B | VB |
| 2.5 | VB | B | B | M | Z | Z | M | B | B | VB |

CONTROL SYSTEM FOR CABLE CRANE

BACKGROUND OF THE INVENTION

1. Field of the Invention

The present invention relates to a control system for a cable crane transporting a concrete in a dam construction site or so forth, for realizing automatic operation.

2. Description of the Related Art

As is well known, a cable crane has been employed as means for transporting concrete from a preparation site to a casting site, such as at a dam construction site or so forth.

As shown in FIG. 24, the cable crane includes a main cable 2 stretched above a dam 1 to be constructed between mountains, between slopes, a trolley 3 suspended from the main cable and capable of traveling therealong, a traction cable 4 for driving the trolley 3, a concrete bucket 6 hanging below the trolley 3 via a hanging cable 5, a transverse winch 7 for driving the traction cable 4 to reciprocally travel the trolley 3 between a transportation start position A at the mountain side and a transportation end position B at a desired position on the bottom of dam, and a vertical winch 8 for extracting and retracting the hanging cable 5 for lifting up and down the bucket 6. In an operation room 9, the position of the trolley 3 and the position of the bucket 6 are monitored for operating respective winches 7 and 8.

At the upper side portion of the transportation start position A, a transporting carrier 10 is traveling in a direction perpendicular to the plane of the drawing for transporting concrete prepared by a not shown batcher plant. On the other hand, a concrete hopper 11 is arranged at the transportation end position B. The trolley 3 is driven to transversely travel along the main cable 2 according to a control signal from the operation room 9, and in conjunction therewith, the bucket 6 is lifted up and down by the hanging cable 5 by the control signal, in order to position the bucket 6 at respective positions A and B. At the position A, the concrete is supplied to the bucket 6, and at the position B, the concrete is discharged from the bucket 6.

In case of a large scale construction, such as a dam, a huge amount of concrete is required. Therefore, in order to shorten the construction period and to reduce the construction cost, it is required to minimize the period required for transporting concrete by the bucket 6 in each transportation cycle. Therefore, as shown by an arrow in FIG. 24, it is desirable to move the bucket 6 between the positions A and B through a path of a minimal distance.

In the cable crane, the magnitude of displacement of the trolley 3 in the transverse direction and the magnitude of displacement of the bucket 6 in the vertical direction can be derived on the basis of amounts of extraction the traction cable 4 and the hanging cable 5 and magnitude of deflection the main cable 2 depending upon the weight loads of the trolley 3, the bucket 6 and the concrete to be transported, from time to time. Accordingly, by deriving a coordinate of the bucket 6 with respect to a certain reference point, such as the transportation start position A, and by commanding forward and reverse rotation, acceleration and deceleration or stopping on the basis of the coordinate of the bucket 6 derived as set forth above, the bucket 6 may be operated automatically along the predetermined minimum distance.

However, in the case of the foregoing method, in which the instantaneous bucket position is measured in real time on the basis of the amount of extraction of the main cable 2 or so forth and the load on the bucket or so forth for moving the bucket 6 along an optimal traveling path, a time lag may be caused for transmitting necessary control information for driving the bucket 6 along the optimal traveling path to the winch drive control system since it will take a certain period for deriving the position of the bucket 6. This practically causes difficulty in driving the bucket 6 along the optimal traveling path. If the driving speeds of the winches are lowered so that the control information can be derived in time, it can take longer than a case where the movement of the bucket 6 is manually controlled by an operator, thus canceling the merit of automatic control. Furthermore, in acceleration and deceleration of the winches, swinging (pitching) motion of the bucket 6 is potentially induced due to inertia moments exerted on the bucket 6. For precisely positioning the bucket 6, it becomes necessary to provide a control for suppressing the swinging motion of the bucket 6.

Conventionally, automatic control is performed until the bucket 6 reaches a position in the vicinity of the position A or position B as the starting point or the destination point, and in the area near each position A and B, the bucket 6 is operated manually for suppressing swinging motion and positioning at the desired point by the operator in the operation room 9 through radio communication with monitoring staff acting at each position A and B and in accordance with the instructions from the monitoring staff.

However, in this method, the qualified staff have to be arranged at each position A and B for providing proper instructions to the operator. In addition, actual fine adjustment on the basis of exchanging of information between the monitoring staff and the operator can cause a substantial delay. Furthermore, the direction and magnitude of control to be provided to the drive control system for the winch tends to be vague. Accordingly, whether the bucket can be positioned within a short period or not mainly depends on the degree of skill of the operator and the monitoring staff. Furthermore, due to manual operation, it cannot be certain whether the transporting operation can be completed within a given period in every transporting operation.

In addition, when the bucket is placed near the position A or B, the workers must move away for avoiding inadvertent accidents, thereby to cause lowering operating efficiency.

SUMMARY OF THE INVENTION

One object of the present invention is to provide a control system for a cable crane, which can operate automatically with high efficiency and precision by modeling behavior of a main cable, a trolley and a bucket and performing automatic operation on the basis of the model.

In order to accomplish the above-mentioned object, there is provided, according to a first aspect of the present invention, a cable crane system including:

a main cable stretched between two points;

a transverse trolley traveling along the main cable;

a traction cable for driving the trolley;

a bucket hung below the trolley via a hanging cable;

a transverse winch for driving the traction cable for reciprocally driving the trolley between a transportation start position and a transportation end position;

a vertical winch for retracting and extracting the hanging cable for lifting the bucket up and down; and driving means for the transverse and vertical winches, wherein a control system for controlling the cable crane system comprising:

means for detecting a weight of an object for transportation including the trolley and the bucket;

means for detecting magnitude and speed of transverse travel of the trolley;

means for detecting magnitude and speed of vertical travel of the bucket;

arithmetic means for deriving a predicted value of a magnitude of deflection of the main cable on the basis of a trace of the main cable preliminarily established as a numerical model corresponding to the overall weight loaded on the main cable, detected by the weight detecting means, a coordinate of a starting point and target destination point of the trolley, and magnitude of transverse travel of the trolley and magnitude of vertical travel of the bucket; and means for controlling the driving means on the basis of the results of arithmetic operation of the arithmetic means.

With the first aspect of the invention, the crane can be automatically operated by controlling travel of the trolley and lifting up and down of the bucket through control of the winch control means along a trace of the main cable established as a numeric model between a start coordinate and a target destination coordinate and a pattern of the trace of the bucket optimized on the basis of the trace of the main cable.

Another object of the present invention is to provide a cable crane control system which can efficiently and precisely perform automatic operation of the crane on the basis of a modeled pattern as in the first mentioned object, and, in addition thereto, can suppress swinging motion of the bucket and achieve high precision in stopping of the crane.

In order to accomplish the second object, there is provided, according to a second aspect of the invention, a cable crane system including:

a main cable stretched between two points;

a transverse trolley traveling along the main cable;

a traction cable for driving the trolley;

a bucket hung below the trolley via a hanging cable;

a transverse winch for driving the traction cable for reciprocally driving the trolley between a transportation start position and a transportation end position;

a vertical winch for retracting and extracting the hanging cable for lifting the bucket up and down; and driving means for the transverse and vertical winches, wherein a control system for controlling the cable crane system comprises:

means for detecting a weight of an object for transportation including the trolley and the bucket;

means for detecting magnitude and speed of transverse travel of the trolley;

means for detecting magnitude and speed of vertical travel of the bucket;

means, provided on the bucket, for detecting a swing angle of the bucket;

arithmetic means for deriving a predicted value of a magnitude of deflection of the main cable on the basis of a trace of the main cable preliminarily established as a numerical model corresponding to the overall weight loaded on the main cable, detected by the weight detecting means, a coordinate of a starting point and target destination point of the trolley, and magnitude of transverse travel of the trolley and magnitude of vertical travel of the bucket;

means for controlling the driving means on the basis of the results of arithmetic operation of the arithmetic means according to a pattern of acceleration—constant speed traveling—deceleration—stopping; and feedback control means for applying the trolley speed detected by the trolley transverse traveling magnitude and speed detecting means, a bucket swing angle and swing direction sequentially detected by the bucket vertical travel magnitude and speed detecting means and the swing angle detecting means, magnitude of extraction of the traction cable detected by a traction cable extraction magnitude detecting means to a predetermined control rule for suppressing swinging motion of the bucket, and driving the driving means with a corrected prediction value corrected by the control rule as a control input.

With the construction set forth above, the bucket is driven and caused to travel and lifted up and down from the starting coordinate to the target destination coordinate according to a modeled pattern of acceleration—constant speed traveling—deceleration—stopping. Control is performed to cancel swinging of the bucket and enhance precision in stopping based on fuzzy inference including control rules upon termination of acceleration, initiation of deceleration and stopping.

In order to accomplish the above-mentioned second object, there is provided, according to a third aspect of the invention, a cable crane system including:

a main cable stretched between two points;

a transverse trolley traveling along the main cable;

a traction cable for driving the trolley;

a bucket hung below the trolley via a hanging cable;

a transverse winch for driving the traction cable for reciprocally driving the trolley between a transportation start position and a transportation end position;

a vertical winch for retracting and extracting the hanging cable for lifting the bucket up and down; and driving means for the transverse and vertical winches, wherein a control system for controlling the cable crane system comprises;

means for detecting a weight of an object for transportation including the trolley and the bucket;

means for detecting magnitude and speed of transverse travel of the trolley;

means for detecting vertical and speed of vertical travel of the bucket;

means, provided on the bucket, for detecting a swing angle of the bucket;

arithmetic means for deriving a predicted value of a magnitude of deflection of the main cable on the basis of a trace of the main cable preliminarily established as a numerical model corresponding to the overall weight loaded on the main cable, detected by the weight detecting means, a coordinate of a starting point and target destination point of the trolley, and magnitude of transverse travel of the trolley and magnitude of vertical travel of the bucket;

means for controlling the driving means on the basis of the results of arithmetic operation of the arithmetic means; and feedback control means for setting a magnitude of deceleration or acceleration and a control timing for canceling swing of the bucket on the basis of the swinging angle and angular velocity of the bucket detected by the bucket swing angle detecting means and driving the driving means based on such set values.

With the construction set forth above, the bucket is driven and caused to travel and lifted up and down from the starting coordinate to the target destination coordinate according to a modeled pattern of acceleration—constant speed traveling—deceleration—stopping. Control is performed to cancel swinging of the bucket and enhance precision in stopping based on fuzzy inference including control rules upon termination of acceleration, initiation of deceleration and stopping. Furthermore, swing suppression control can be repeated a plurality of times until the amplitude of swinging coverages within an allowable range.

The third object of the present invention is to provide a cable crane control system which can make judgement on the basis of external variable factors, such as wind velocity, wind direction and variation of wind direction for selecting an optimal one of a plurality of control systems or for terminating operation.

In order to accomplish the foregoing third object, there is provided, according to a fourth aspect of the present invention, a cable crane system including:

a main cable stretched between two points;

a transverse trolley traveling along the main cable;

a traction cable for driving the trolley;

a bucket hung below the trolley via a hanging cable;

a transverse winch for driving the traction cable for reciprocally driving the trolley between a transportation start position and a transportation end position;

a vertical winch for retracting and extracting the hanging cable for lifting the bucket up and down; and driving means for the transverse and vertical winches, wherein a control system for controlling the cable crane system comprises;

means for detecting a weight of an object for transportation including the trolley and the bucket;

means for detecting magnitude and speed of transverse travel of the trolley;

means for detecting magnitude and speed of vertical travel of the bucket;

means, provided on the bucket, for detecting a swing angle of the bucket;

arithmetic means for deriving a predicted value of a magnitude of deflection of the main cable on the basis of a trace of the main cable preliminarily established as a numerical model corresponding to the overall weight loaded on the main cable, detected by the weight detecting means, a coordinate of a starting point and target destination point of the trolley, and magnitude of transverse travel of the trolley and magnitude of vertical travel of the bucket;

first control means for controlling the driving means on the basis of the results of arithmetic operation of the arithmetic means;

second control means for setting values of a magnitude of deceleration or acceleration and a control time for canceling swinging of the bucket on the basis of the swing angle and angular velocity of the bucket detected by the bucket swing angle detecting means and outputting feedback control information based on such set values;

third control means for applying the trolley speed detected by the trolley transverse travel magnitude and speed detecting means, a bucket swing angle and swing direction sequentially detected by the bucket vertical travel magnitude and speed detecting means and the swing angle detecting means, a magnitude of extraction of the traction cable detected by a traction cable extraction magnitude detecting means to a predetermined control rule for suppressing swinging motion of the bucket, and outputting a corrected prediction value corrected by the control rule as feedback control information;

fourth control means for storing a driving process of the driving means by manual operation and outputting an operation pattern on the basis of the stored content;

selecting means for selecting one of the first to fourth control means according to a predetermined control rule in terms of an external variable factor; and drive control means for operating the driving means for respective winches from starting according to a control pattern based on the control information provided from the one of the first to fourth control means selected by the selecting means.

With the construction set forth above, an optimal control method can be selected to achieve the most efficient operation taking into account safety depending upon the external variable factor. If necessary in view of safety, the crane operation is terminated.

A fourth object of the present invention is to provide a cable crane control system which includes a monitoring system capable of constantly monitoring the positions of the trolley and the bucket at day and at night and easily deriving the magnitude and speed of travel.

In order to accomplish the above-mentioned object, there is provided, according to a fifth aspect of the invention, a cable crane system including:

a main cable stretched between two points;

a transverse trolley traveling along the main cable;

a traction cable for driving the trolley;

a bucket hung below the trolley via a hanging cable;

a transverse winch for driving the traction cable for reciprocally driving the trolley between a transportation start position and a transportation end position;

a vertical winch for retracting and extracting the hanging cable for lifting the bucket up and down; and driving means for the transverse and vertical winches, wherein a cable crane monitoring system comprises:

first image pick-up means for picking-up an image of an overall scene, the first image pick-up means having an imaging range covering an overall region, in which the bucket of the cable crane travels;

second image pick-up means for picking-up a scene of an imaging region at a trolley stopping means;

third image pick-up means for picking-up a scene of an imaging region; and an arithmetic means connected to respective image pick-up means for performing an arithmetic operation for extracting position information and speed information of an imaging object on the basis of image information from respective image pick-up means.

With the construction set forth above, the current positions of the trolley and the bucket can be checked without direct observation by human eyes. In particular, significant points for control, e.g. the trolley stop position and the lowered position of the bucket, can be precisely monitored. Also, the image information picked-up by respective image pick-up means can be used as crane control information processed by the arithmetic circuit.

BRIEF DESCRIPTION OF THE DRAWINGS

The present invention will be understood more fully from the detailed description given herein below and from the accompanying drawings of preferred embodiments of the present invention, which, however, should not be taken to be limitative to the invention, but are for explanation and understanding only.

In the drawings:

FIG. 13 is an illustration showing a relationship between variation of speed of a trolley and a swinging motion of a bucket during deceleration;

FIG. 14(*a*) and 14(*b*) are tables showing control rules applicable during deceleration of the trolley;

FIG. 15(*a*)–15(*e*) are tables showing control rules applicable upon stopping the trolley;

DESCRIPTION OF THE PREFERRED EMBODIMENTS

Figure 1:
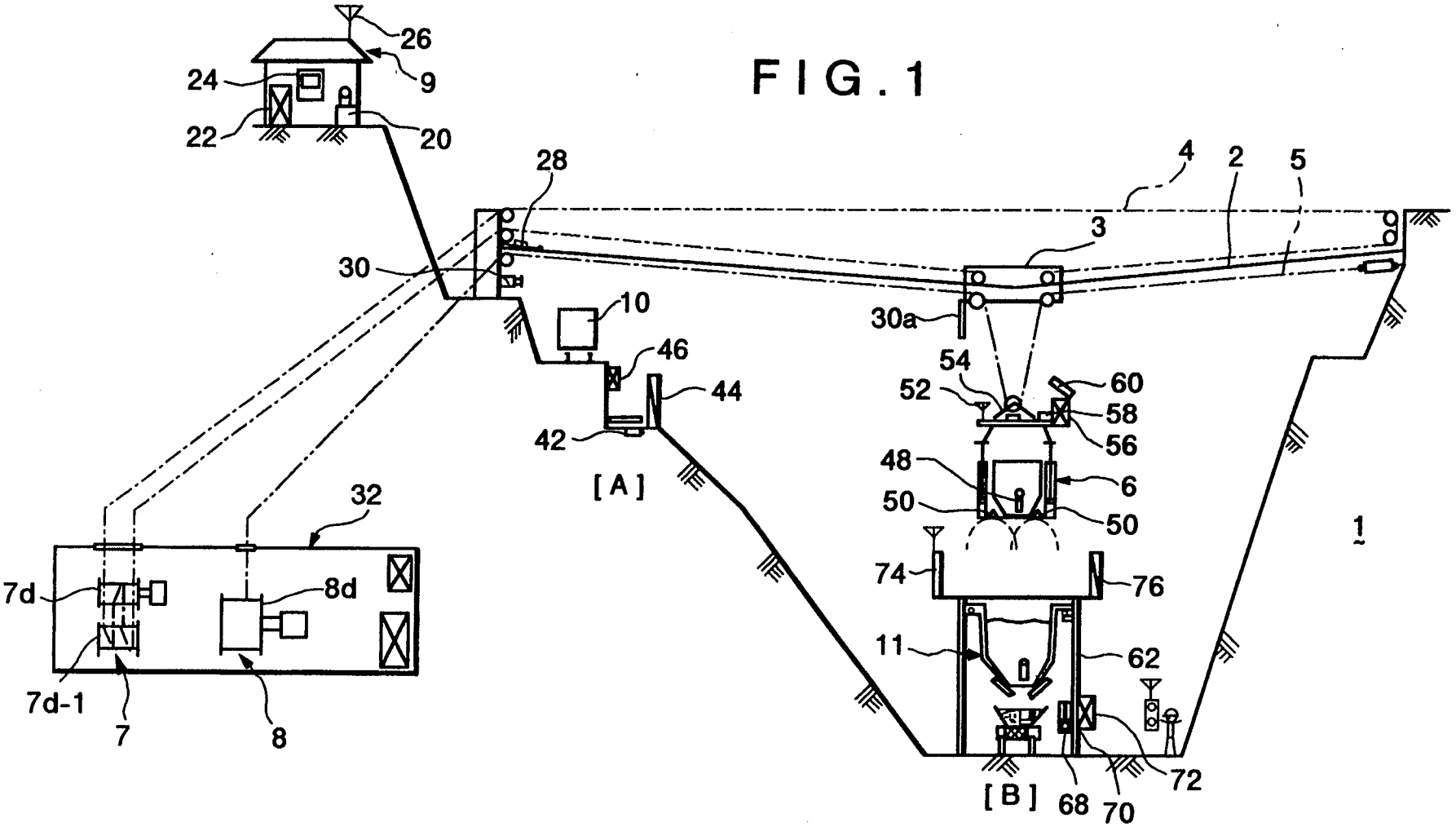
FIG. 1 is a diagrammatic illustration showing the overall construction of a cable crane according to the present invention.

The first embodiment of a cable crane control system according to the present invention will be discussed hereinafter. It should be appreciated that like reference numerals represent like components to the conventional system, and components different from and added to the conventional system will be represented by new reference numerals, in the following disclosure.

Figure 2:
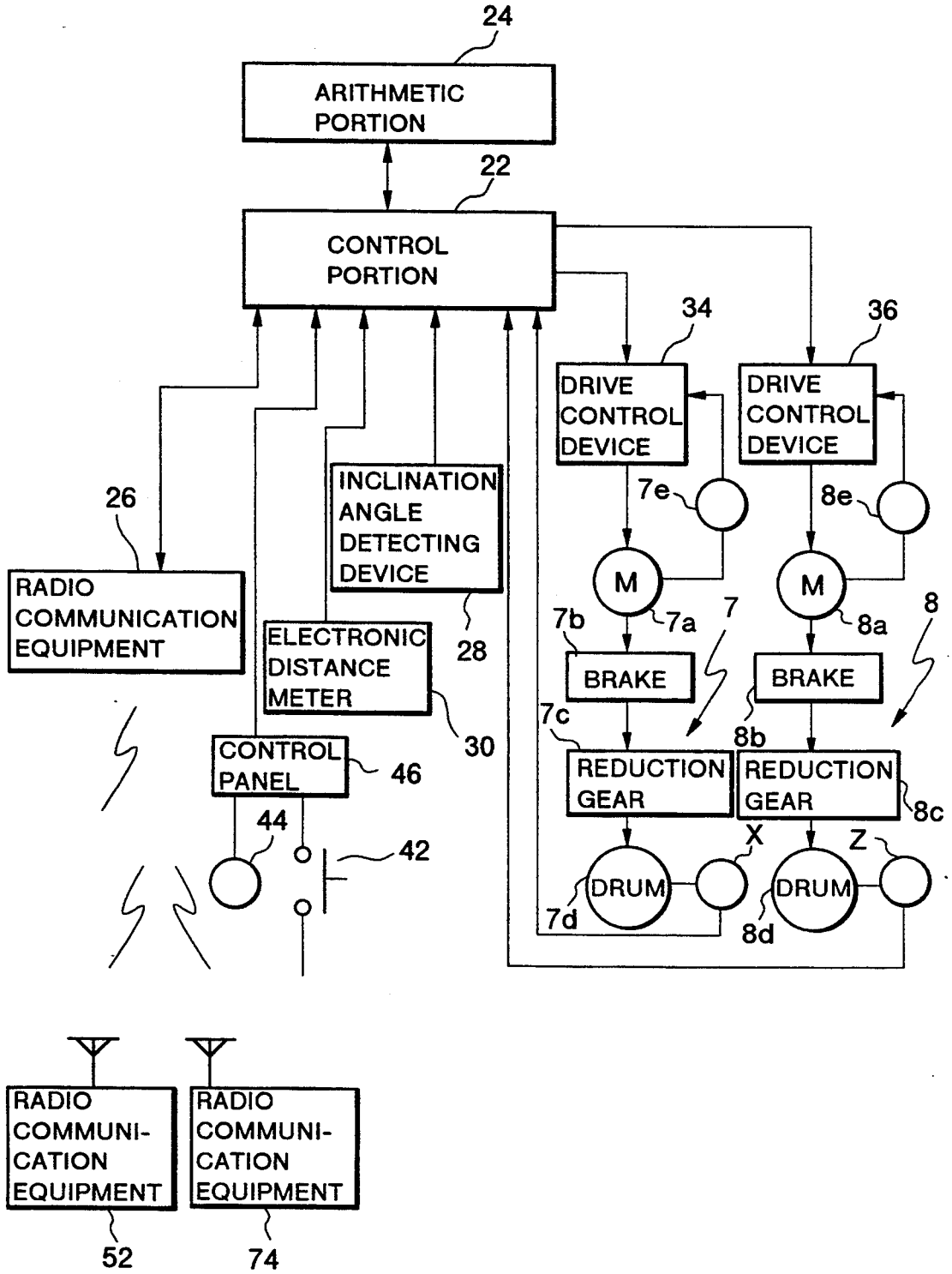
FIG. 2 is a block diagram of the first embodiment of a cable crane control system according to the present invention.

FIG. 1 is a diagrammatic illustration showing the overall construction of a cable crane system of the present invention, and FIG. 2 is a block diagram showing a system construction of the invention.

Figure 24:
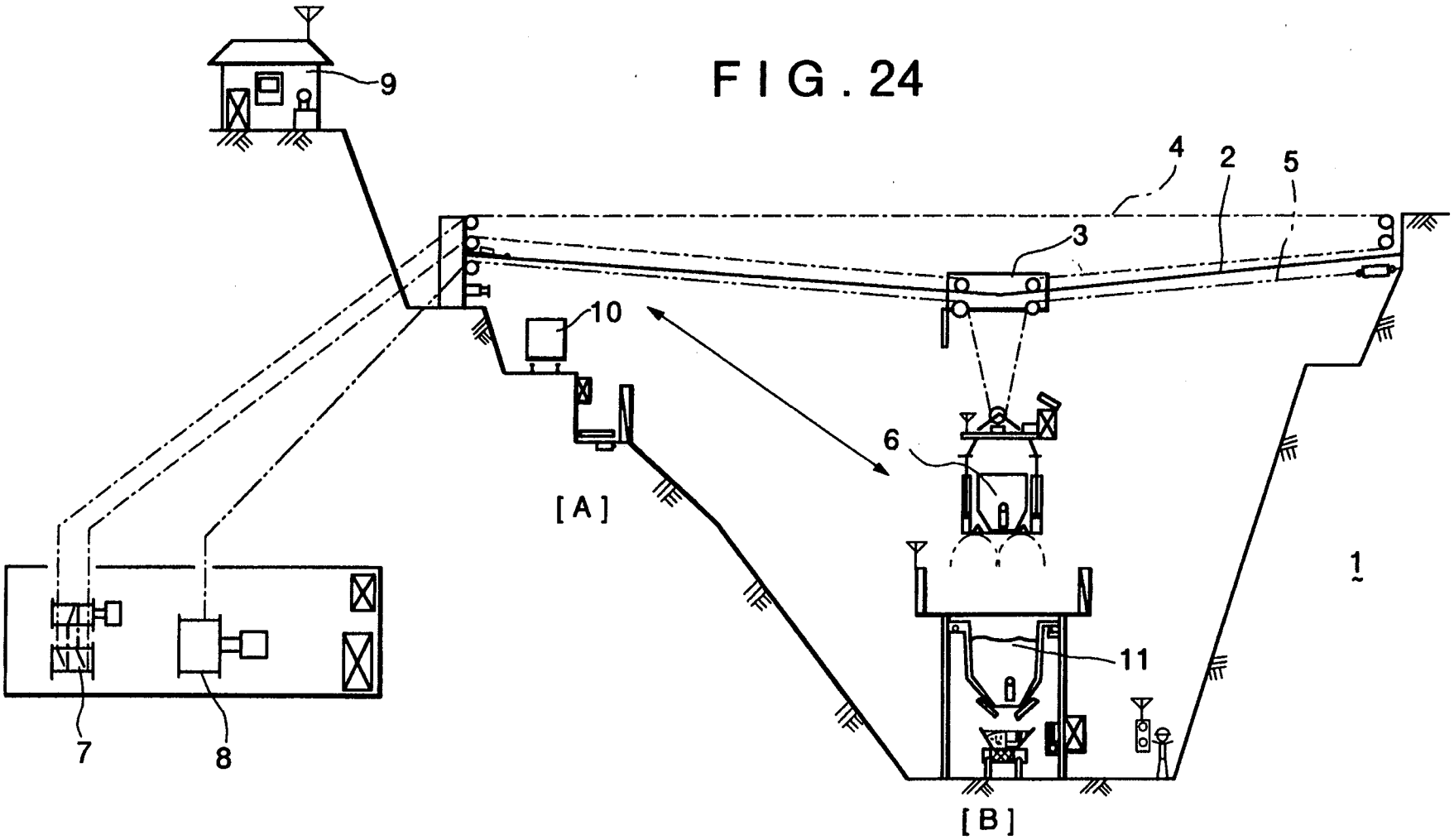
FIG. 24 is an explanatory diagrammatic illustration showing typical construction of a conventional cable crane.

The cable crane system illustrated in FIG. 1 generally has the same construction to the conventional system illustrated in FIG. 24. The cable crane system includes the main cable 2 stretched above the dam 1 to be constructed between mountains, between slopes, the trolley 3 suspended from the main cable and capable of traveling therealong, the traction cable 4 for driving the trolley 3, the concrete bucket 6 hanging below the trolley 3 via the hanging cable 5, a transverse winch 7 for driving the traction cable 4 to reciprocally travel the trolley 3 between the transportation start position A at the mountain side and the transportation end position B at the desired position on the bottom of dam, and the vertical winch 8 for extracting and retracting the hanging cable 5 for lifting up and down the bucket 6. In the operation room 9, the position of the trolley 3 and the position of the bucket 6 are monitored for operating respective winches 7 and 8.

At the upper side portion of the transportation start position A, the transporting carrier 10 is traveling in the direction perpendicular to the plane of the drawing for transporting concrete prepared by a not shown batcher plant. On the other hand, the concrete hopper 11 is arranged at the transportation end position B.

In the operation room 9 are provided an operation table 20 operating the winches 7 and 8, a control portion 22 for commanding various operational modes for respective winches 7 and 8, an arithmetic portion deriving an optimal traveling pattern of the trolley 3 and an optimal lifting pattern of the bucket 6 and providing such patterns to the control portion 22, and radio communication equipment 26.

At a base end of the main cable 2 are arranged an inclination angle detecting device 28 and an electronic distance meter 30. The inclination angle detecting device 28 is adapted to detect an inclination angle of the main cable 2 relative to a reference line (e.g. a horizontal line) at a stop position immediately above the transportation start position A of the trolley 3. The electronic distance meter 30 detects a coordinate of the trolley 3 at a starting position. The inclination angle detecting device 28 and the electronic distance meter 30 are respectively connected to the control portion 22. It should be noted that a vertically elongated reflection plate 30*a* is provided on the trolley 3 for covering a range of irradiation of light emitted from the electronic distance meter 30.

The transverse winch 7 and the vertical winch 8 are arranged in a machine house 32 located in the vicinity of the main cable 2. The winches 7 and 8 are driven in forward and reverse directions and for acceleration and deceleration by drive control units 34 and 36, as shown in FIG. 2. The drive control units 34 and 36 are connected to the control portion 22 for receiving control commands therefrom.

Respective winches 7 and 8 include motors 7*a* and 8*a*, brakes 7*b* and 8*b*, reduction gear assemblies 7*c* and 8*c*, and drums 7*d* and 8*d*. The motors 7*a* and 8*a* are coupled with respectively corresponding drums 7*d* and 8*d* via the brakes 7*b* and 8*b* and the reduction gear assemblies 7*c* and 8*c* for extracting and retracting the traction cable 4 and the hanging cable 5. It should be noted that the transverse winch 7 is adapted to retract the traction cable 4 in an endless form for retracting an extracting the traction cable 4 wound on an intermediate drum 7*d*-1 and the drum 7*d* at both ends.

Motor speed detectors 7*e* and 8*e* are provided for respective motors 7*a* and 8*a*. The motor speed detectors 7*e* and 8*e* feed back detected values to the driven control units 34 and 36. The motors 7*a* and 8*a* are controlled by control command values provided by the control portion 22 for driving in proper directions and at proper speeds.

On the drums 7*d* and 8*d* are provided respective encoders X and Z. The encoder X is adapted to detect a magnitude transverse travel of the trolley 3. On the other hand, the encoder Z is adapted to detect a magnitude of lifting up and down of the bucket 6. Respective outputs of the encoders X and Z are input to the control portion 22. It should be noted that the transverse traveling magnitude detection value may contain an error due to slippage at the intermediate drum 7*d*-1, and thus is corrected at the time of every arrival of the trolley at the position A with the measured value of the electronic distance meter 30.

A bottoming confirming switch 42 is provided on a banker line as the transportation start position A. Also, in the vicinity of the banker line are arranged an area sensor 44 and a control panel 46. The bottoming confirming switch 42 detects bottoming of the bucket 6. The area sensor 44 is adapted to be used for controlling bottoming of the bucket 6. The bucket 6 can be bottomed within a detection range of the area sensor 44. The control panel 46 permits operation for feeding the concrete into the bucket 6 from the transporting carrier 10.

At the lower portion of the bucket 6 are provided an opening and closing gate (not shown) which is operated by a hydraulic cylinder, a limit switch 48 for detecting opening and closing of the gate, and an ultrasonic area sensor 50. On the other hand, at the upper portion of the bucket 6 are provided radio communication equipment 52, a gyro-type swing angle detector 54, a control panel 56, a battery 58 for supplying power for the foregoing components and a solar-type recharging unit 60. The outputs of the limit switch 48, the ultrasonic area sensor 50, the swing angle detector 54 are transmitted to the control portion 22 in the operation room 9 via the radio communication equipments 52 and 26.

The hopper 11 is supported on a support frame 62. On the lower portion of the hopper 11 are provided a not shown opening and closing gate, which is operated by means of a hydraulic cylinder, and a limit switch 64 for detecting opening and closing of the gate. On a leg of the support frame 62 are arranged a concrete discharging manual switch 68, a display unit 70, a control panel 72 and so forth, at positions easy to see and operate from a driver's seat of a dump truck stopping below the hopper 11. On the upper portion of the support frame 62 are provided a radio communication equipment 74 and an ultrasonic area sensor 76 for detecting the stop position of the bucket 6. The output signals of the limit switch 64, the manual switch 68, the area sensor 76 are transmitted to the control portion 22 in the operation room 9 via the radio communication equipments 74 and 26.

In the arithmetic portion 24 of FIG. 2 is provided a control program for providing operation patterns of the winches 7 and 8 for the control portion 22. Next, discussion will be given for the control process according to the control program. At first, on the basis of an equation expressing a static equilibrium corresponding to the position of the trolley 3 on the main cable 2, and an equation for deriving a spring constant k of the main cable 2, a deflection model of the main cable 2 showing variation of a trace of the main cable 2 associated with the traveling motion of the trolley 3 is derived. Next, a coordinate representative of a predicted position of the bucket 6 corresponding to the deflection model of the main cable 2 is determined. Then, the extraction lengths of the traction cable 4 and the hanging cable are obtained as a function of time.

Figure 3:
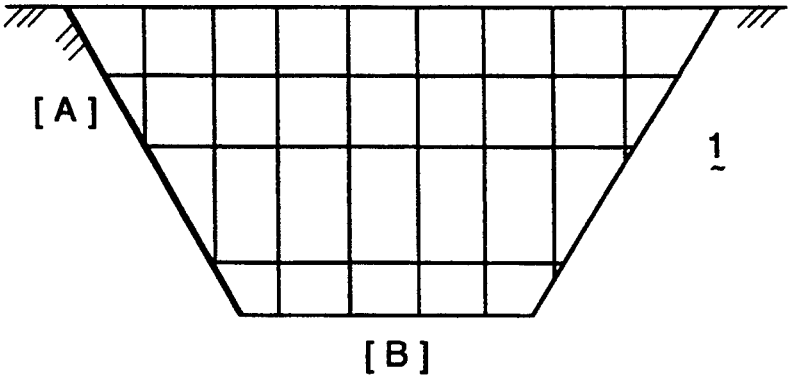
FIGS. 3(*a*), 3(*b*) and 3(*c*) are explanatory illustrations showing content of control in the first embodiment of the cable crane control system of the invention.
Figure 3:
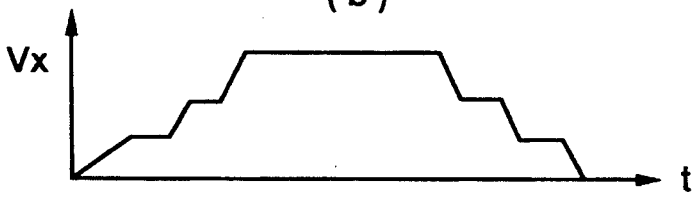
Figure 3:
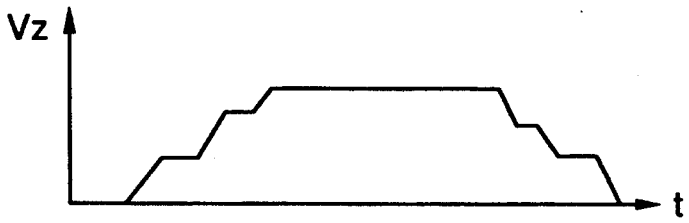

As shown in FIG. 3(*a*), a concrete transporting area in the dam 1, namely, the area where the bucket 6 is driven to travel, is divided into a group of a plurality of small grid blocks. The traveling speed of the trolley 3 and the lifting speed of the bucket 6 are derived as the operation pattern for minimizing periods to pass respective blocks while taking into account suppression of swinging of the bucket 6. In the operation pattern, the traveling speed Vx of the trolley 3 is initially increased in a stepwise fashion, and then becomes constant and subsequently decreased in stepwise fashion to be zero at a target coordinate position, as shown in FIG. 3(*b*). Also, the lifting speed Vz of the hanging cable 5 of the bucket 6 is set in a similar pattern to the operation pattern of the trolley 3, as shown in FIG. 3(*c*). Namely, the traveling speed of the trolley 3 and the lifting speed of the bucket 6 become zero at a transition from one block to another adjacent block. That is, the trolley 3 and the bucket 6 repeat the operation patterns of FIGS. 3(*b*) and 3(*c*) every time to pass each block determined by the deflection model of the main cable 2. The discontinuous stepwise variation of speed during acceleration and deceleration periods is intended to cancel swinging motion of the bucket 6 to be inducted by acceleration and deceleration. By the shown manner of acceleration and deceleration, the swinging motion of the bucket 6 at the target position (the transition point from one block to another block) can be completely suppressed.

With this operation pattern, the magnitude of deflection of the main cable 2 is variable depending upon a tension of the main cable 2 and a total load including the weight of the bucket 6 applied on the main cable 2. Assuming that the tension acting on the main cable 2 is a known constant value, the operation pattern and the operation period in the foregoing program can be determined by inputting the total load as a parameter. Since the weight of the main cable 2, the trolley 3 and the bucket 6 are also known, the operation pattern and the operation period can be determined when the weight of the concrete to be fed in the bucket 6 is determined.

Kinds of concrete are variable depending upon the casting portion and type of construction among mortar, medium-consistency concrete, and stiff-consistency concrete. The specific weight of the concrete is variable depending upon the kind of concrete. Therefore, when the capacity of the bucket 6 is constant, the weight of the concrete to be filled in the bucket 6 depends on the kind of concrete. The concrete prepared by the batcher plant is transported on the banker line by the transporting carrier 10, and information of the kind of concrete is transmitted to the operation room 9 and the bucket 6.

The control portion 22 receives the information of the kind of concrete and then operates the drive control units 34 and 36 according to the program stored in the arithmetic portion 24. The control according to the program in the arithmetic portion 24 will be discussed herebelow.

Figure 4:
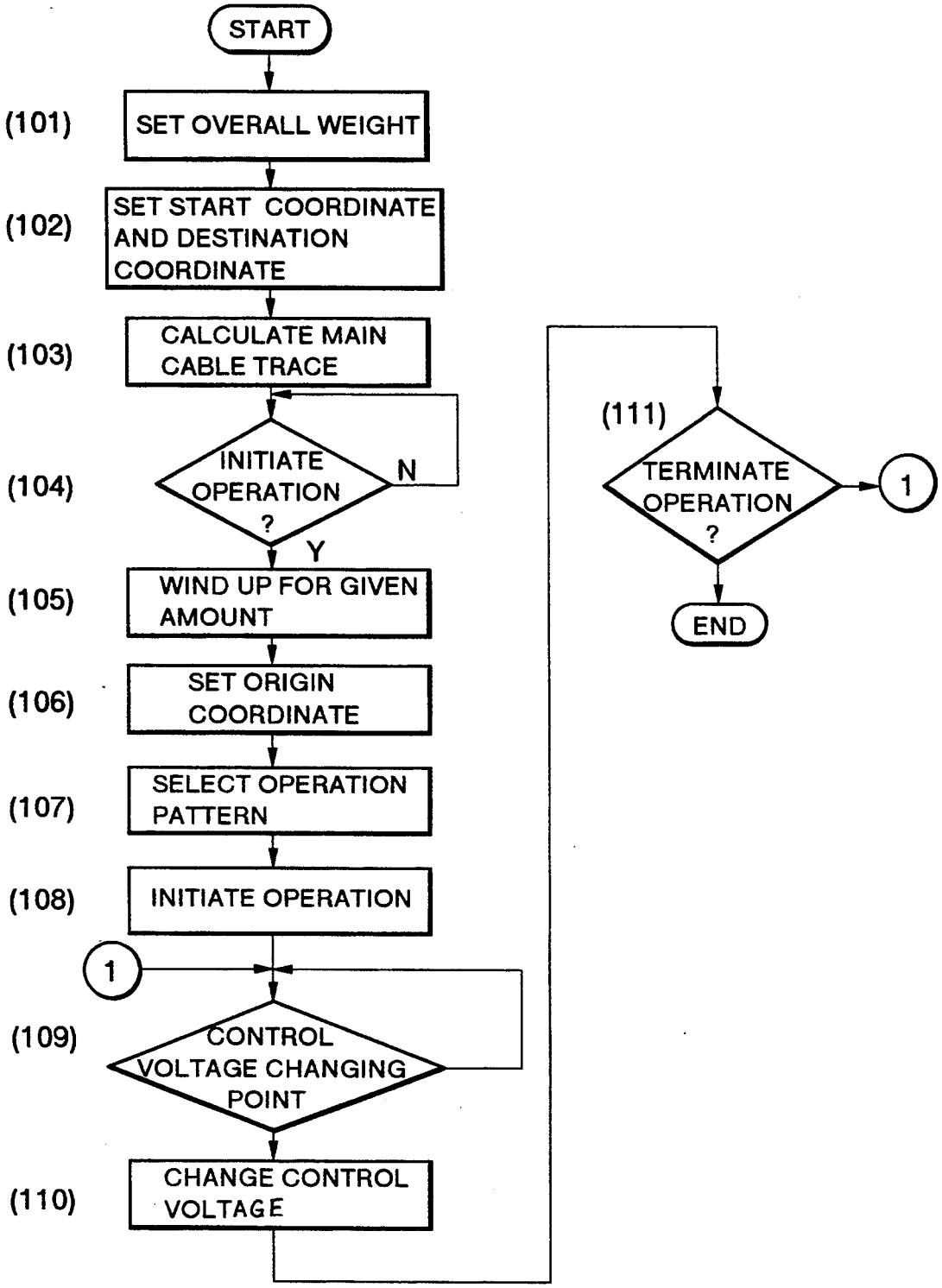
FIG. 4 is a flowchart showing control of a process of control in a travel from a transportation start position to a transportation end position, which will be referred to hereafter as loaded travel, in the first embodiment of the cable crane control system of the invention.

FIG. 4 is a flowchart showing a control process according to the foregoing control program in the loaded travel (from the position A to the position B). In the loaded travel, at the condition where the bucket 6 is bottomed at the transportation start position A, the concrete is fed into the bucket 6 and the kind of concrete is designated. Then, the total load on the main cable 2 is derived. Subsequently, depending upon the results of detection by the electronic distance meter 30 and the inclination angle detecting device 28, the starting coordinate position and a destination coordinate position are determined, and then, the trace of the deflection of the main cable 2 is determined (steps 101–103).

When the bucket 6 is ready for transportation and when the control portion 22 receives an operation OK signal from the control panel 46 on the banker line, the hanging cable 5 is slightly wound up. At this condition, the position of the trolley 3 is also shifted. Therefore, an origin coordinate at starting of transportation is set. The operation patten for the initial block is then selected and operations of respective winches are initiated (steps 104–108).

During operation, the control portion 22 constantly monitors the transverse traveling magnitude and speed of the trolley 3, extraction magnitude and speed of the hanging cable 5 by the encoders X and Z. When judgement is made that the speed of the traction cable 4 driving the trolley 3 or the hanging cable 5 reaches a preliminarily programmed speed transition point on the basis of the inputs from the encoders X and Z, the control command is provided from the arithmetic portion 24 to the control portion 22 so that control voltages for the winches 7 and 8 become consistent with a commanded value of the control program (steps 109 and 110). It should be noted that in the steps 109 and 110 respective speed variation points in the charts of the operation patterns in FIGS. 3(*b*) and 3(*c*) in each block are detected for varying the control voltage. The steps 109 and 110 are repeated until the bucket 6 reaches the final block, in which the destination coordinate position is included. The transporting operation if terminated when judgement is made that the instantaneous coordinate position of the bucket 6 is consistent with the destination coordinate position set at the step 102 (step 111).

At the operation terminated condition, the bucket 6 has reached at the position immediately above the hopper 11. Subsequently, on the basis of the detected values of the ultrasonic sensors 50 and 76 provided on the bucket 6 and the hopper 11, automatic fine adjustment of the horizontal position of the bucket 6 relative to the hopper 11 is performed. Thereafter, at the adjusted predetermined position, the bucket 6 is stopped and opens the gate to discharge the concrete into the hopper 11 to complete all operations of loaded travel.

Figure 5:
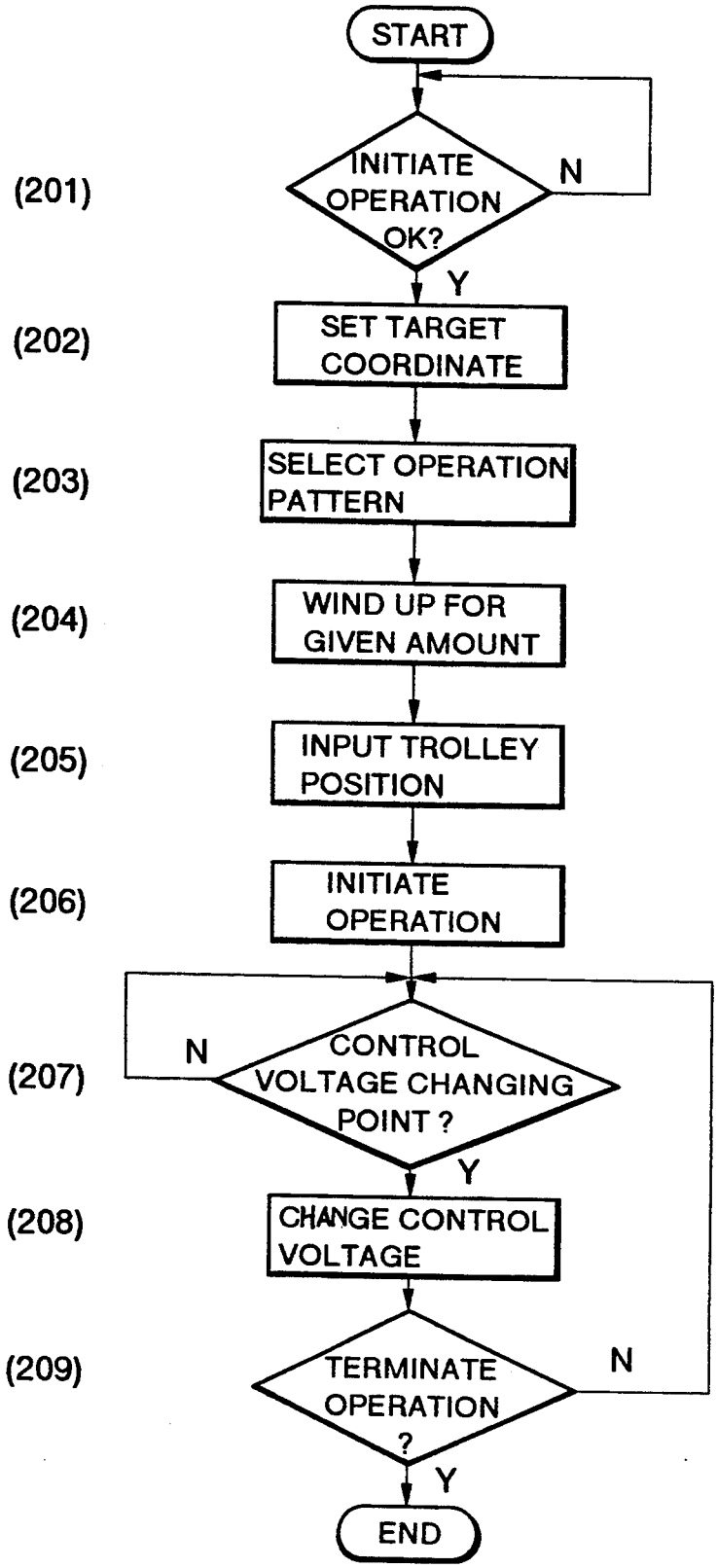
FIG. 5 is a flowchart showing a process of a travel from a transportation end position to a transportation start position, which will be referred to as return travel, in the first embodiment of the cable crane control system of the invention.

For return travel, the operation is almost the same as that in the loaded travel. However, as shown in FIG. 5, when the control portion 22 receives a signal indicative of ready state for operation via the radio communication equipments 52 and 26, the starting coordinate position and the destination coordinate position are set and the operation pattern for empty condition is selected. After detecting the instantaneous coordinate position of the trolley 3, the operation for return travel is initiated (steps 201–206).

After initiation of the operation, the control portion 22 constantly monitors the transverse traveling magnitude and speed of the trolley 3 and the lifting up magnitude of the hanging cable 5 by the encoders X and Z. When judgement is made that the speed of the traction cable 4 driving the trolley 3 or the hanging cable 5 reaches a preliminarily programmed speed transition point on the basis of the inputs from the encoders X and Z, the control command is provided from the arithmetic portion 24 to the control portion 22 so that the control voltages for the winches 7 and 8 become consistent with a commanded value of the control program (steps 207 and 208). It should be noted that, similarly to the steps 109 and 110, the steps 207 and 208 are repeated until the bucket 6 reaches the final block, in which the destination coordinate position is included. The transporting operation if terminated when judgement is made that the instantaneous coordinate position of the bucket 6 is consistent with the destination coordinate position set at the step 202 (step 209).

At this operation completed position, the bucket 6 is positioned immediately above the banker line. Subsequently, on the basis of the detected values of the ultrasonic sensors 50 and 44 provided on the bucket 6 and the banker line, automatic fine adjustment of the horizontal position of the bucket 6 relative to the banker line is performed. After positioning, the bucket 6 is bottomed on the banker line. Then, bottoming of the bucket 6 is confirmed by the switch 42 and bucket 6 is in a state ready for receiving concrete.

Figure 6:
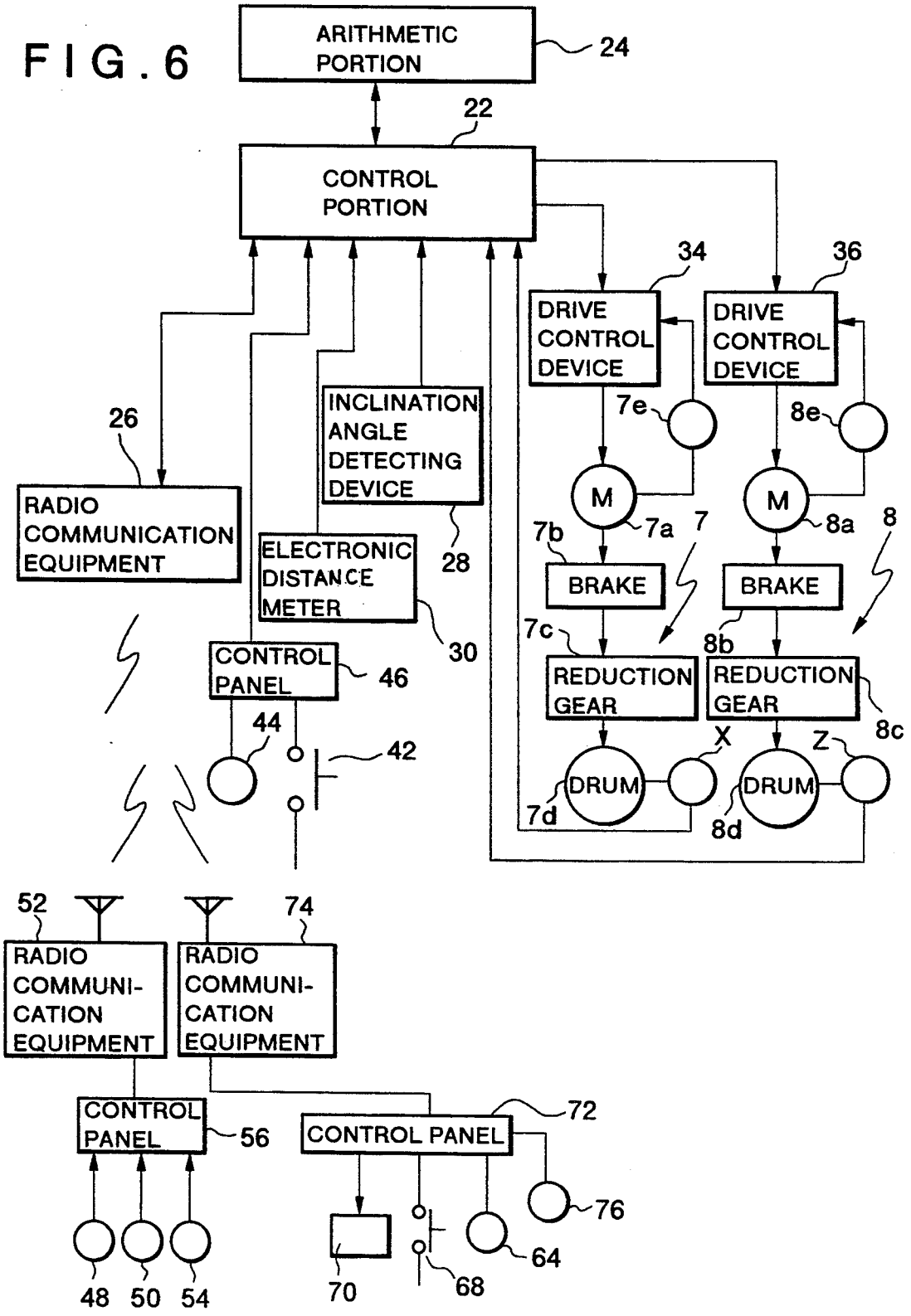
FIG. 6 is a block diagram of a second embodiment of a cable crane control system according to the invention.

Next, the second embodiment of the present invention will be discussed with reference to the drawings. The construction of the cable crane system of the second embodiment of the invention is substantially the same as that in the first embodiment as shown in FIG. 1. FIG. 6 is a block diagram of the second embodiment of the cable crane control system according to the invention. The block diagram of FIG. 6 is generally similar to that of the first embodiment shown in FIG. 2.

A control program for providing operation patterns of the winches 7 and 8 for the control portion 22 is provided in the arithmetic circuit 24 of FIG. 6. Next, discussion will be given for the control process according to the control program. At first, on the basis of an equation expressing a static equilibrium corresponding to the position of the trolley 3 on the main cable 2, and an equation for deriving a spring constant k of the main cable 2, a deflection model of the main cable 2 showing variation of a trace of the main cable 2 associated with the traveling motion of the trolley 3, is derived. Next, a coordinate representative of a predicted position of the bucket 6 corresponding to the deflection model of the main cable 2 is determined. Then, the extraction lengths of the traction cable 4 and the hanging cable are obtained as a function of time.

The control program is provided with a function for selecting a feedback magnitude to be provided via the operation control of the winches 7 and 8 for canceling swinging angle and swinging angular velocity of the bucket 6 through fuzzy inference.

Figure 7:
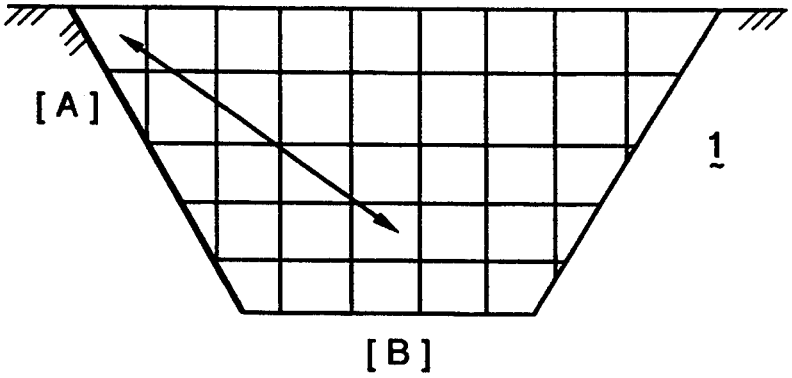
FIGS. 7(*a*), 7(*b*) and 7(*c*) are explanatory illustrations showing content of control in the second embodiment of the cable crane control system of the invention.
Figure 7:
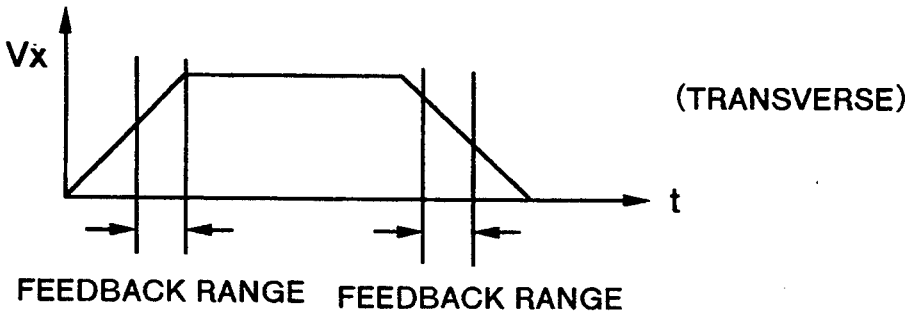
Figure 7:
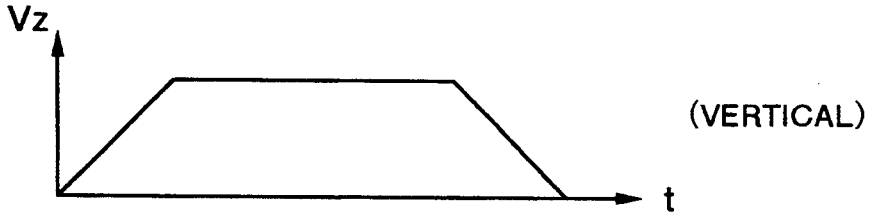

As shown in FIG. 7(*a*), an area of the motion of the bucket is divided into a group of a plurality of small grid blocks. The traveling speed of the trolley 3 and the lifting speed of the bucket 6 are derived as the operation pattern for minimizing periods to pass respective blocks while taking into account suppression of swinging of the bucket 6. In the operation pattern in the shown embodiment, the traveling speed Vx of the trolley 3 is initially increased from the starting coordinate position at substantially constant acceleration, and then becomes constant and subsequently decreased at a substantially constant deceleration to be zero at a target coordinate position, as shown in FIG. 7(*b*). Also, the lifting speed Vz of the hanging cable 5 of the bucket 6 is set in a similar pattern to the operation pattern of the trolley 3, as shown in FIG. 7(*c*). Namely, the traveling speed of the trolley 3 and the lifting speed of the bucket 6 become zero at a transition from one block to another adjacent block. That is, the trolley 3 and the bucket 6 repeat the operation patterns of FIGS. 7(*b*) and 7(*c*) every time to pass each block determined by the deflection model of the main cable 2.

In the operation patten of FIGS. 7(*b*) and 7(*c*), at initiation of acceleration, termination of acceleration, initiation of deceleration and stopping, swinging (pitching) of the bucket 6 is induced due to delay of response caused by moments of inertia on the bucket 6 in response to acceleration and deceleration of the trolley 3. The arithmetic portion 24 performs feedback control for the winches 7 and 8 on the basis of fuzzy inference for canceling swinging moments corresponding to swing angle and swing angular velocity of the bucket 6 during acceleration and deceleration and upon stopping. Accordingly, in practice, the speed-time curve of the trolley 3 and/or the bucket 6 is not linear but is stepwise during acceleration and deceleration.

The control portion 22 provides control commands to the drive control units 34 and 36 according to the program stored in the arithmetic portion 24 after receiving information of the kind of concrete, as in the foregoing first embodiment. In addition, the arithmetic circuit 24 performs feedback control in fuzzy inference for suppressing swinging of the bucket 6 during acceleration and deceleration.

Figure 8:
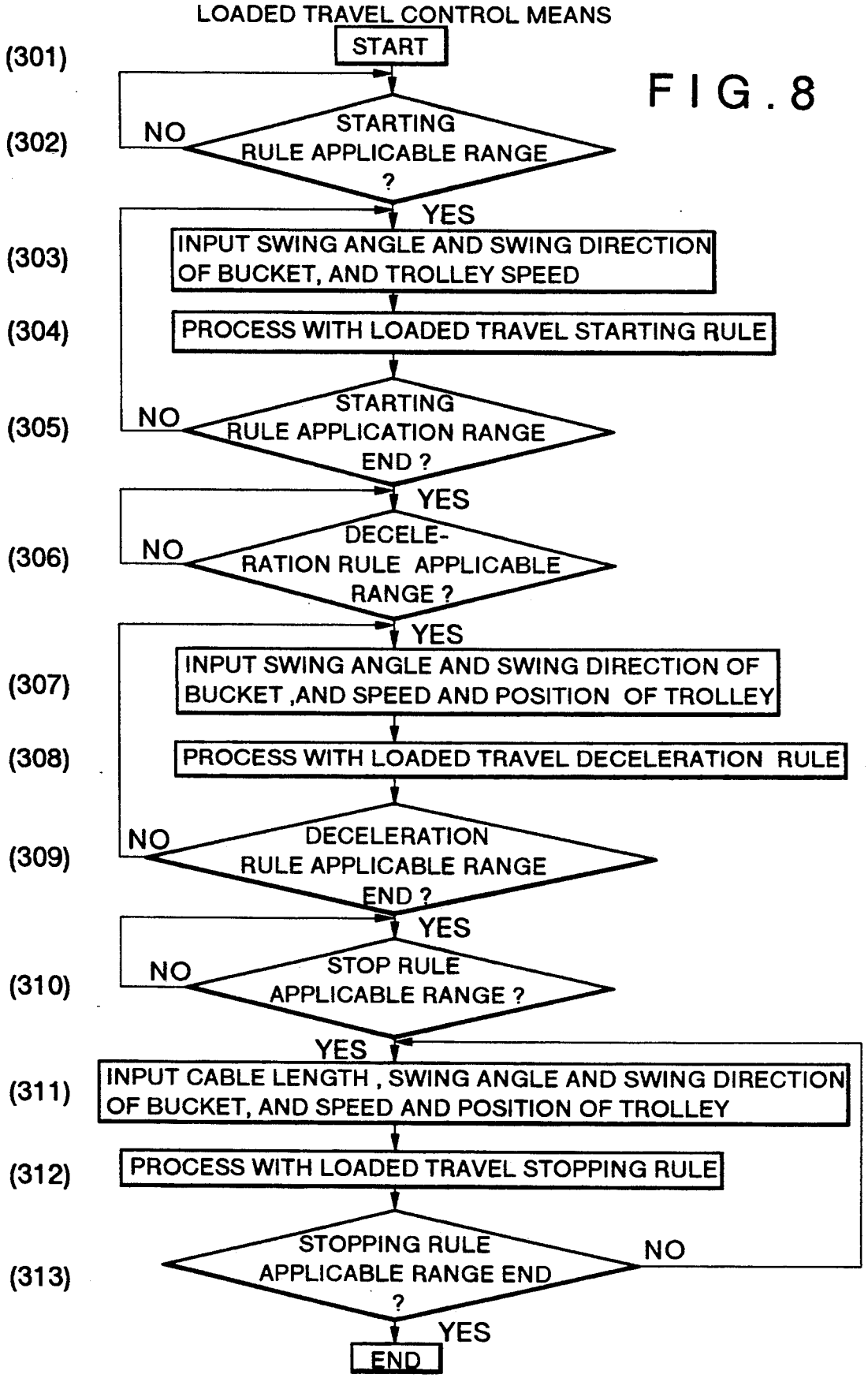
FIG. 8 is a flowchart showing control of a process of loaded travel, in the second embodiment of the cable crane control system of the invention.

FIG. 8 shows a control process for the winches 7 and 8 for loaded travel (from the position A to the position B). When the operation of the crane is initiated, at first acceleration of the trolley is initiated. Subsequently, the trolley speed and the lifting speed of the bucket 6 are in ranges for applying a starting rule based on fuzzy inference, the swing angle and swing direction of the bucket 6 and the speed of the trolley 3 are input to the arithmetic portion. Then, according to a starting rule of the bucket 6 contained in the control program stored in the arithmetic portion 24, swing suppressive process is performed (steps 301–304).

Subsequently, when the range for applying the starting rule ends and a range to apply a deceleration rule of fuzzy inference is entered, the swing angle and swing direction of the bucket 6 and the speed of the trolley 3 are input to the-arithmetic portion. Then, according to the deceleration rule of the bucket 6 contained in the control program stored in the arithmetic portion 24, swing suppression process is performed (steps 305–308).

When the range for applying the deceleration rule is ended and a range for applying a stop rule of fuzzy inference is entered, the swing angle and swing direction of the bucket 6 and the speed of the trolley 3 are input to the arithmetic portion. Then, according to the stop rule of the bucket 6 contained in the control program stored in the arithmetic portion 24, a process for stopping is performed (steps 309–313).

Figure 9:
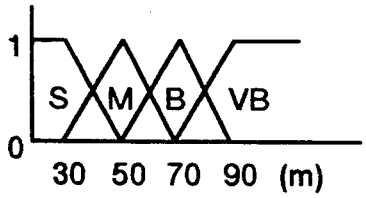
FIGS. 9(*a*)–9(*g*) are graphs showing functions with respect to respective input parameters.
Figure 9:
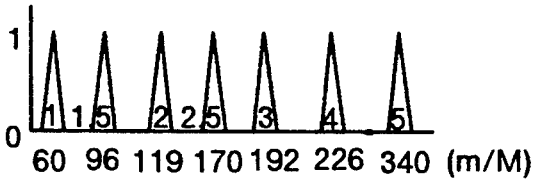
Figure 9:
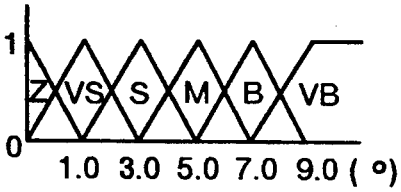
Figure 9:
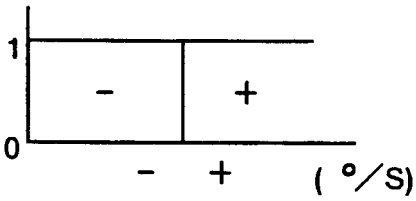
Figure 9:
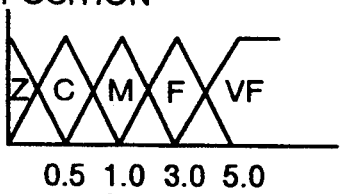
Figure 9:
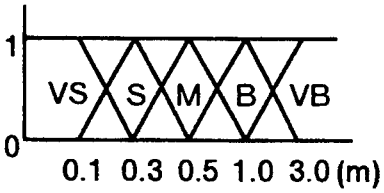
Figure 9:
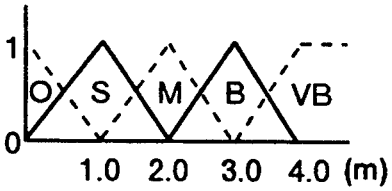

FIGS. 9(*a*)–9(*g*) show functions for establishing correspondence between various input parameters providing index of control and content of fuzzy inference. Explanation will be given for respective content hereinafter.

(a) Length of Hanging Cable 5

The length of the hanging cable 5 hanging the bucket 6 from the trolley 3 is shown divided into four ranges. The length of 0–50 m is referred to as S (small) range, 30–70 m is referred to as M (medium) range, 50–90 m is referred to as B (big) range, and 70 m or more is referred to as VB (very big) range. For example, if the length is 50 m, judgement is made that probability to be in the M range is maximum, and probability to be S or B range is zero.

(b) Trolley Speed

A control command controls motors for driving the winches 7 and 8. In FIG. 9(*b*), there are illustrated 1–5 notches providing seven ranges of traveling speed (m/min) of the trolley 3.

(c) Swing Angle of Bucket

Six ranges of swing angle of the bucket 6 with respect to a vertical line are illustrated. The swing angle less than 1° is referred to as Z (0) range, 0–3.0° as VS (very small) range, 1.0–5.0° as S (small) range, 3.0–7.0° as M (medium) range, 5.0–9.0° as B (big) range and 7.0° or more as VB (very big) range.

(d) Swing Direction of Bucket

The swing direction is referred to as positive (+) if upstream with respect to the traveling direction, and as negative (−) if downstream.

(e) Offset From Deceleration Initiating Position

This parameter represents a magnitude of offset of the position where deceleration of the trolley 3 is actually initiated, in relation to the deceleration initiating position derived from the numerical model. The range of 0–0.5 m is referred to as Z (0) range, 0.00–1.0 m as C (close) range, 0.5–3.0 m as M (medium)range, 1.0–5.0 m as F (far) range and 3.0 or more as VF (very far) range.

(f) Swing of Bucket After Stopping and Acceleration

This parameter represents the amplitude of swing of the bucket after stopping or acceleration. Judgement is made that 0–0.3 m is VS (very small) range, 0.1–0.5 m is S (small) range, 0.3–1.0 m is M (medium) range, 0.5–3.0 m is B (big) range and 1.0 m or more is VB (very big) range.

Figures 10, 11:
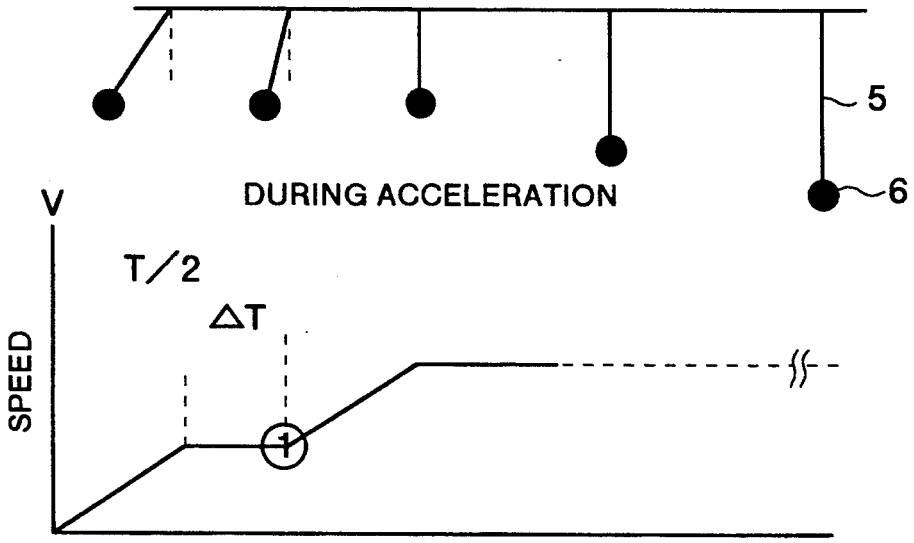
FIG. 10 is an illustration showing a relationship between variation of speed of a trolley and swinging motion of a bucket during acceleration.
FIG. 11 is a table showing a control rule applicable upon starting of the trolley.
Figure 12:
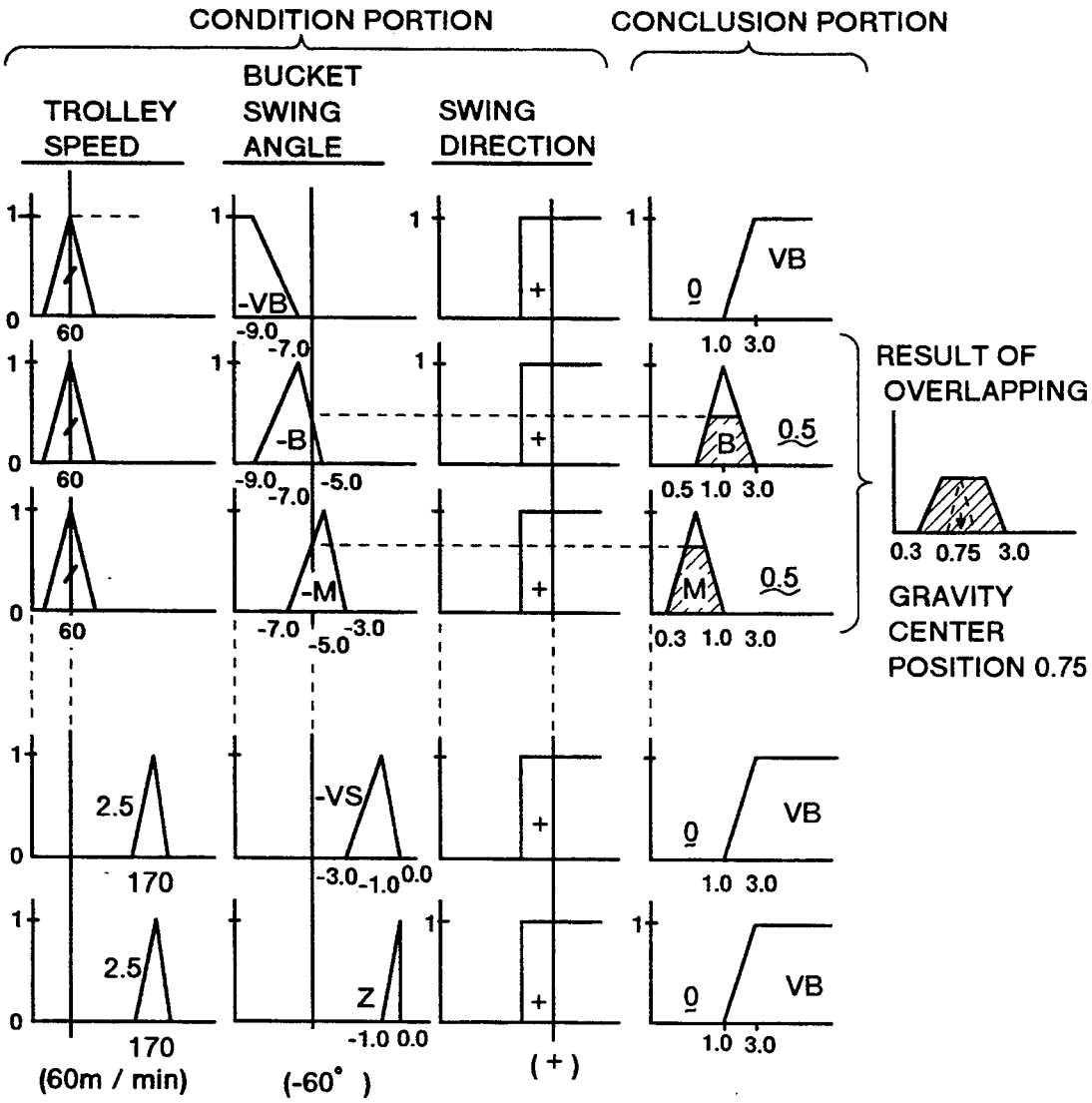
FIG. 12 is an illustration of content of a fuzzy prediction to be applied upon starting of the trolley.

Based on the functions defined above, the feedback control method employing fuzzy inference will be discussed herebelow. FIG. 10 is an explanatory illustration showing swing condition of the bucket 6 when the trolley 3 is accelerated, FIG. 11 is a table showing a control rule to be applied upon starting of the trolley 3, and FIG. 12 is an explanatory illustration showing the content of fuzzy inference during acceleration of the trolley.

As shown in FIG. 10, upon increasing of the traveling speed of the trolley from starting, the bucket 6 swings in the delaying direction (−) due to delay of response caused by inertia. Considering suppression of such swinging motion in two stages, when a constant speed period ΔT is provided during the acceleration period, the bucket 6 is returned to the advancing side (+) for a certain magnitude at the position (1) due to inertia.

By again accelerating at a timing (1), inertial movement in advancing direction of the bucket 6 and acceleration of the trolley 3 is synchronized. Therefore, at the transition from a state of acceleration to a state of constant speed after termination of the acceleration state, the bucket 6 is at the neutral position as shown. Accordingly, by constantly detecting the swing angle and the swing direction of the bucket 6 and traveling speed of the trolley 3, inference is made whether the advancing side swing amplitude of the bucket 6 at the timing (1) becomes the set swing amplitude on the basis of the swing angle of the bucket 6 and the traveling speed of the trolley 3. At the timing (1), re-acceleration is performed with an acceleration derived on the basis of the result of such inference, the bucket 6 can be maintained at the neutral position upon termination of acceleration as shown.

FIG. 11 shows the content of the control rule upon starting. In FIG. 11, the trolley speed, the swing angle of the bucket and the swing direction of the bucket are input parameters. This control rule employs "If Then" logical expression, in which the portion following "If" is a condition portion and the portion following "Then" is a conclusion portion. For example, if the input parameters of the condition portions are that the trolley speed is minimum corresponding to 1 notch, the swing angle of the bucket is 0 and swing direction is +, the conclusion portion shows the logical rule requiring a medium (M) range of amplitude swinging of the bucket. When the amplitude of swinging of the bucket obtained by this control rule is a set swinging amplitude, the obtained swinging amplitude is converted into voltage to be fed back to the drive control unit 34 for the transverse winch 7.

FIG. 12 shows a concrete example of the input parameters for the condition portion and output parameter of the conclusion portion of the control rule of using the functions shown in FIGS. 9(*b*), 9(*c*), 9(*d*) and 9(*e*). As can be seen from the matrix showing the amplitude of swing of the bucket as the output parameter of FIG. 11, the actual number of combinations of the input parameters is twenty-four. However, for simplification, some of the combinations are omitted from illustration in FIG. 12.

When the trolley speed, the swing angle and swing direction of the bucket are given, probabilities for respective rules can be derived with reference to the membership functions. The swing amplitude of the bucket can be predicted by modifying and overlapping the membership function of the swing amplitude on the basis of the probabilities on respective rules. Here, consideration is given for the case where the instantaneous trolley speed is 60 m/min (corresponding to 1 notch), the bucket swing angle is 6.0° and the swing direction is +. For respective input parameters, probabilities are derived from the membership function. For example, in the second upper combination in FIG. 12, the probability 1.0 is obtained for the trolley speed, 0.5 is obtained for the swing angle and 1.0 is obtained for the bucket swing direction. When a plurality of conditions are present, the condition having the minimum probability is taken. Therefore, the probability of the shown example becomes 0.5. In case of the third combination in FIG. 12, the bucket swing angle −M intersects the detected value −6.0°. Therefore, the value 0.5 is taken as the solution in the conclusion portion. It should be noted that for combinations other than the second and third combinations set forth above, the measured swing angle of the bucket does not intersect any membership function. Therefore, the values of the conclusion portions become zero in such cases.

In the arithmetic portion 24, the modified membership functions obtained at the conclusion portions of FIG. 12 are overlapped for deriving a gravity center position. Then prediction can be made that when the trolley 3 is accelerated at the current timing, the swing amplitude at the constant speed travel will be 0.75. Here, when a tolerance upon reaching a state for constant speed traveling of the trolley is 0.4, judgement can be made that re-acceleration should be initiated at the timing where the predicted value becomes less than or equal to 0.4. When such judgement is made, the control signal for acceleration is transmitted to the control portion 22 for suppressing swinging motion of the bucket 6.

In the shown embodiment, from the start and from the position (1) to the time where the trolley 3 enters into the constant speed mode of travel, the hanging cable is held not extracted and is maintained at the constant length for hanging the bucket 6. By maintaining the length of the hanging cable 5 constant, the period of swinging motion of the bucket 6 becomes constant so as to avoid that the control factors become complicated. During the period from initiation of constant speed travel-of the trolley to the time for deceleration, the hanging cable 5 is extracted sequentially to approach the bucket 6 to the hopper 11.

On the other hand, while swing suppression is performed only once in the shown example, as shown in FIG. 10, feedback control for suppressing the swinging motion of the bucket may be performed a plurality of times.

Next, discussion will be given for control during deceleration and stopping. FIGS. 13–15 show the rules for deceleration and stopping depending upon the swinging condition of the bucket 6 and speed variation of the trolley 3.

At first, FIG. 13 shows behavior of the bucket during the period from initiation of deceleration to stopping. Assuming that deceleration of the trolley 3 is initiated at a time (2), the bucket 6 swings in the advancing side (+) due to inertial delay of response. It should be noted that even during constant speed travel, the bucket 6 possibly swings in advancing or delaying directions. Therefore, at the time (2), inference is made applying the deceleration rule shown in FIG. 14(*a*) so that amplitude of swinging can be minimized by deceleration control when the result of the inference becomes smaller than or equal to a given allowable value, and subsequently switching to constant travel.

It should be noted that although the extraction length of the hanging cable 5 is not uniform in the range near the decelerating position, the rule of FIG. 14(*a*) is applicable for the overall length R of the hanging cable 5.

On the other hand, the actual position to initiate deceleration may be offset from the targeted deceleration initiating position derived from the numerical model due to delay of control as shown by broken lines in FIG. 13. The applicable rule depending upon the relationship between the offset distance and the speed is shown in FIG. 14(*b*). In practical control, operations according to respective rules are performed for obtaining respective independent results of inference. Then, an average value of the results of inference is obtained as the final result. In the alternative, when either of the control rules is given preference, the final results may be calculated from the individual results of inference while providing respective weighting values therefore according to the preference, for performing control for the trolley 3. For instance, when preference is given for suppression of the swinging motion of the bucket 6, the weighting value 0.6 is given for the swing factor while the weighting value 0.4 is given for the offset factor. It should be appreciated that although the swinging motion suppressive control takes place only once in FIG. 13, the swinging motion suppressive control may be performed a plurality of times in the deceleration rule.

Next, for judgement upon stopping at a time (3), the rules shown in FIGS. 15(*a*)–15(*d*) are applicable depending upon the swing angle while the swing angle is in the delay side (−). Namely, when the swinging motion of the bucket 6 is in the delay side or direction (−), the swinging motion can be canceled by advancing the trolley 3 at a speed depending upon the magnitude of the swing angle. In the shown embodiment, the amount of control is variable depending upon the extraction length R of the hanging cable 5 upon stopping. Four ranges are used, i.e. (a) short (S), (b) medium (M), (c) long (B) and (d) very long (VB). The control rules are given for respective ranges.

For offset of the stopping position, a rule shown in FIG. 15(*e*) is applied. Similarly to the case of acceleration set forth above, the control is performed with an average value of the value derived by the swing suppression control rule and the value derived by the offset control rule, or with a value derived by providing weighting values for the value derived by the swing suppression control rule and the value derived by the offset control rule depending upon preference for either of such controls.

Figure 16:
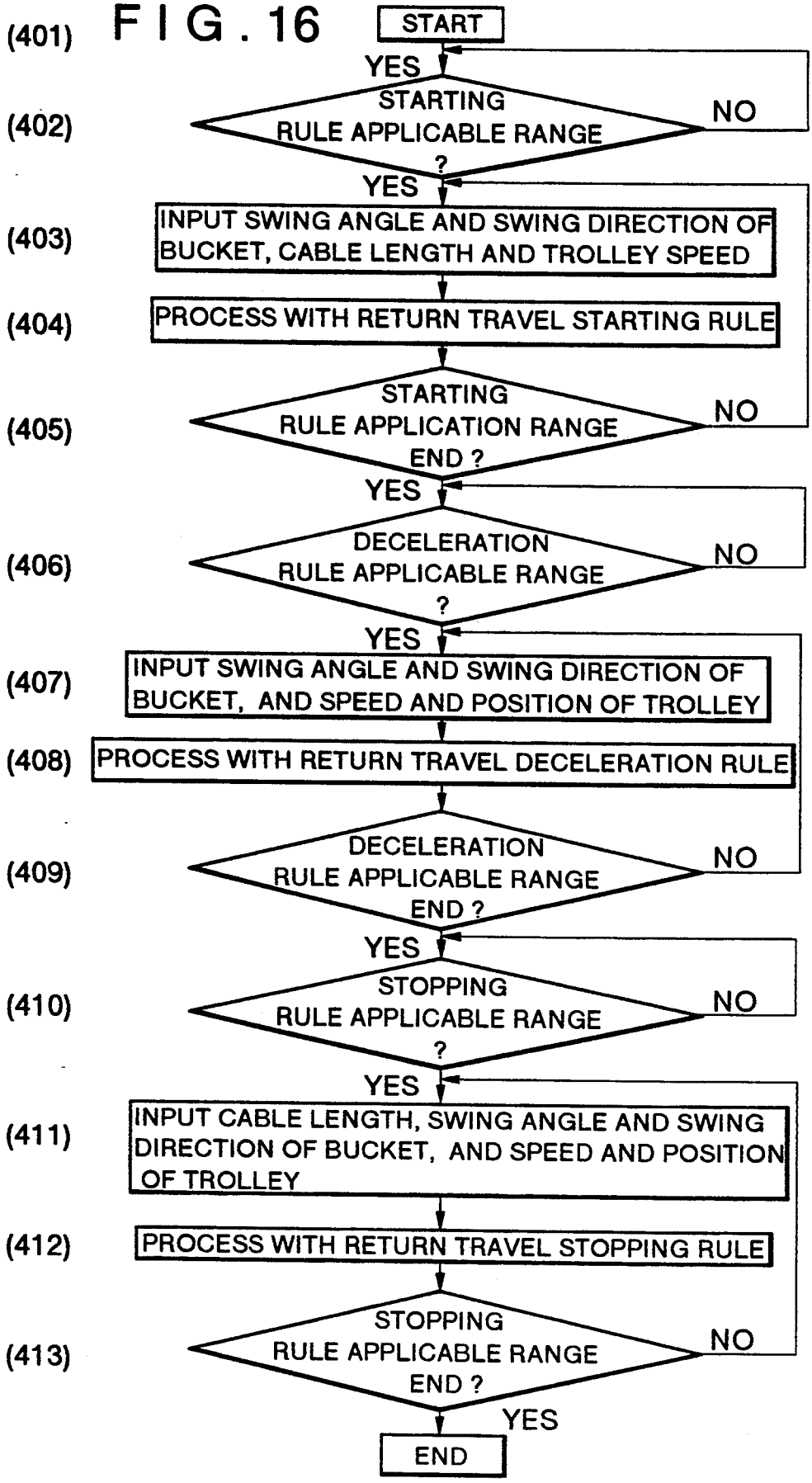
FIG. 16 is a flowchart showing a control process in the return travel of the crane in the second embodiment of the invention.

FIG. 16 shows a control process for return travel from the transportation end position B to the transportation start position A. When the operation of the crane is initiated, at first acceleration of the trolley is initiated. Subsequently, the trolley speed and the lifting speed of the bucket 6 are in ranges for applying a starting rule based on fuzzy inference. The swing angle and swing direction of the bucket 6, the length of the hanging cable 5 and the speed of the trolley 3 are input to initiate swing suppression process according to a starting rule contained in the control program stored in the arithmetic portion 24 (steps 401–404).

Subsequently, when the range for applying the starting rule ends and a range to apply a deceleration rule of fuzzy inference is entered, the swing angle and swing direction of the bucket 6 and the speed and position of the trolley 3 are input to the arithmetic portion 24. Then, according to the deceleration rule of the bucket 6 contained in the control program stored in the arithmetic portion 24, swing suppression process is performed (steps 406–408).

When the range for applying the deceleration rule ends and a range for applying a stopping rule of fuzzy inference is entered, the swing angle and swing direction of the bucket 6 and the speed and position of the trolley 3 are input to the arithmetic portion 24. Then, according to the stopping rule of the bucket 6 contained in the control program stored in the arithmetic portion 24, a process for stopping is performed (steps 409–413).

It should be noted that the control rules for loaded travel are applicable for return travel except for the difference of length of the hanging cable 5 and for the difference of the traveling direction. Therefore, detailed discussion of such control rules not provided.

Figure 17:
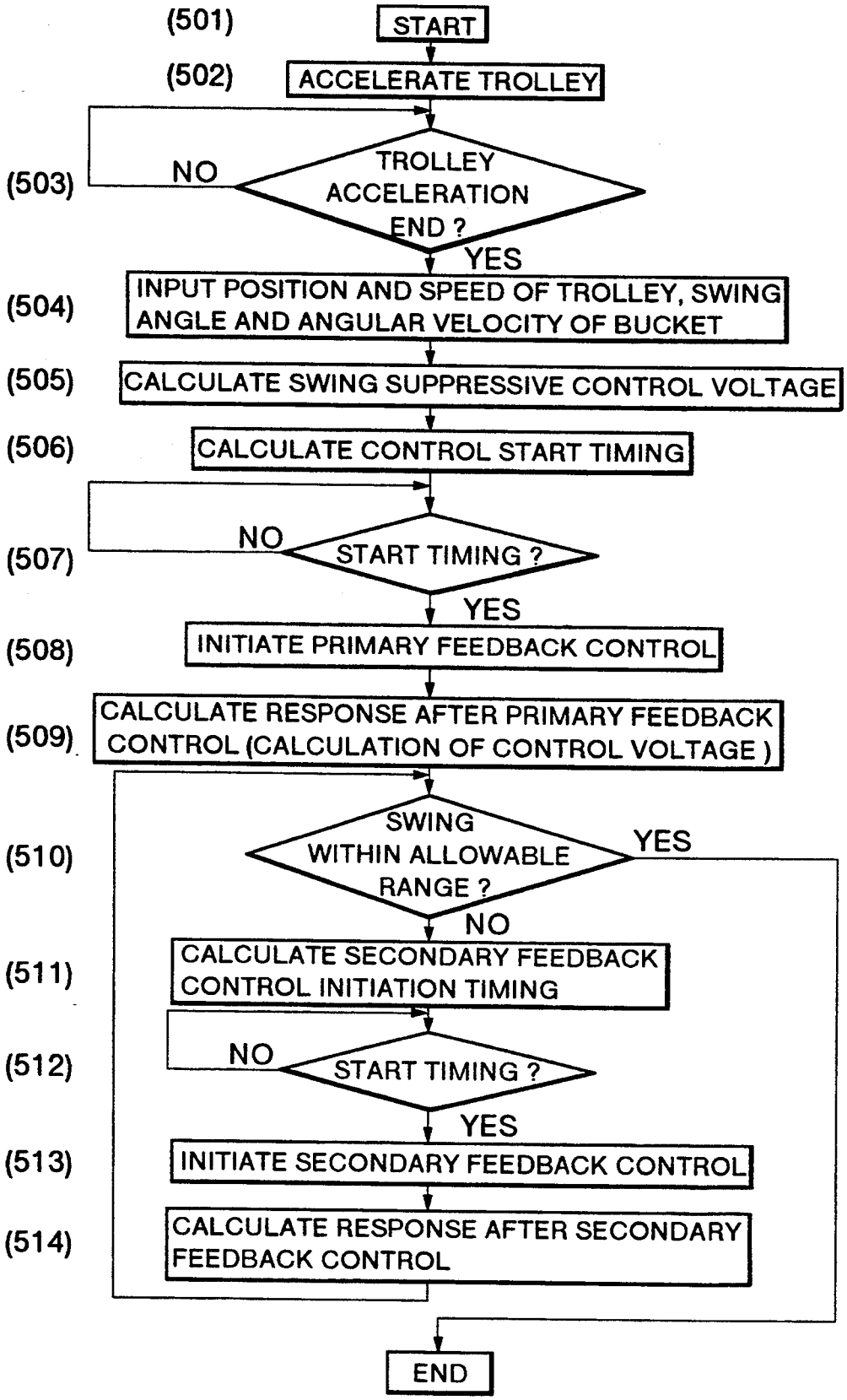
FIG. 17 is a flowchart showing a control process in a third embodiment of the cable crane control system of the invention.

Next, discussion will be given of the third embodiment of the cable crane control system according to the present invention. In the third embodiment, a control routine for effectively suppressing the swinging motion of the bucket is added to the control program for acceleration in the foregoing second embodiment. FIG. 17 shows a control process in the acceleration state in this embodiment, and FIG. 18 shows the relationship between the speed of the trolley 3 and the swinging motion of the bucket 6 corresponding to the content of control.

As shown in FIG. 17, at a time when acceleration of the trolley 3 is terminated after initiation of the crane operation, the position and speed of trolley 3 and the swing angle and the swing angular velocity of the bucket 6 are input to the control portion 22. With these values, an equation of motion of the bucket 6 is substituted for deriving a control voltage for suppression of the swinging motion of the bucket 6 to follow the trace curve of the main cable 2 derived in a manner similar to that discussed above and for calculating a control start time (steps 501–507). It should be noted that the position and the speed of the trolley 3 is given by encoder X and speed meter 7*e*, and the swing angle and the angular velocity are detected by swing angle detector 54 and transmitted through radio communication equipments 28 and 52.

Figure 18:
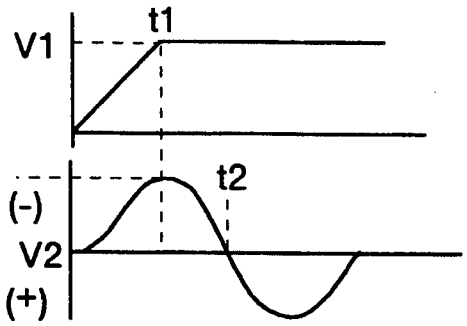
FIGS. 18(*a*), 18(*b*) and 18(*c*) are graphs showing relationship between variation of speed of the trolley and the swinging motion of the bucket during acceleration.
Figure 18:
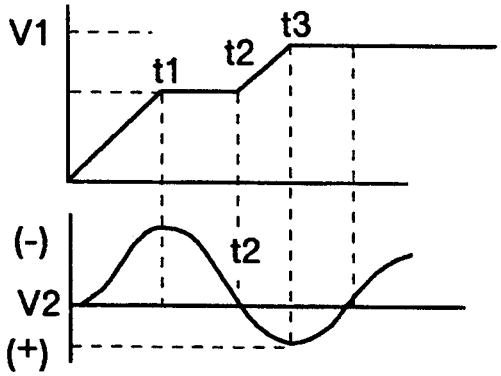
Figure 18:
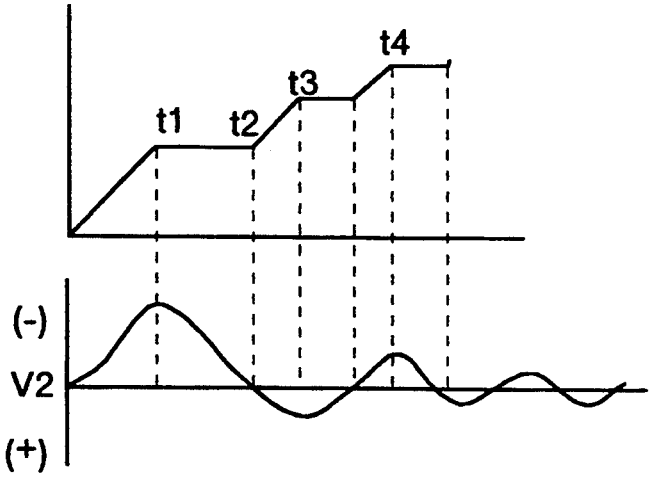

As shown in FIG. 18(*a*), assuming that a period required to reach the speed of the trolley 3 at a constant speed v1 from initiation of operation is $t_1$, the swinging motion is induced on the bucket 6 by delay in response due to its inertia. A trace of the amplitude of swing v2 of the bucket 6 becomes a sine curve of a constant period if the length of the hanging cable 5 for hanging the bucket 6 is constant. Accordingly, in order to cancel swinging motion of the bucket 6, a time $t_2$ at which the swing amplitude v2 becomes zero after the time $t_1$, at which the speed of the trolley 3 becomes constant, and an acceleration corresponding to a value at which the swing amplitude v2 becomes maximum, at the time $t_2$ is applied for a predetermined period.

This is, when a start time $t_2$ is reached, a primary feedback control to provide a control voltage for accelerating the trolley 3 is provided to the drive control unit 34 for the predetermined period. The swing angle and the angular velocity of swing of the bucket 6 after completion of the primary feedback control are measured to derive the subsequent swing condition. As a result, when the expected swing of the bucket 6 is within an allowable value range, the feedback control is terminated (steps 508 and 509). The condition where the primary feedback control is performed up to a time $t_3$ is illustrated in FIG. 18(*b*). If the maximum value of the swing amplitude v2 of the bucket 6 is within the allowable range during this period (i.e. $t_2$–$t_3$), the feedback control is terminated.

Conversely, when the maximum value of v2 exceeds the allowable value, in a manner similar to that set forth above, a secondary feedback control initiation timing $t_4$, at which the amplitude of swing v2 becomes zero at the first time after the time $t_3$ is derived. When the timing $t_4$ is reached, the control voltage derived at the step 509 is applied for the predetermined period. Then, the swing angle and the angular velocity of swinging of the bucket 6 after completion of the secondary feedback control are measured (steps 510–514). The condition after the secondary feedback control is illustrated in FIG. 18(*c*). During this period ($t_3$–$t_4$), if the maximum value of the swinging amplitude v2 is within the allowable value range, the secondary feedback control is terminated. On the other hand, when the maximum value of v2 exceeds the allowable value, similar feedback control is repeated until the maximum value of v2 is within the allowable value by returning to the step 510.

It should be noted that the swing suppression control to be performed during deceleration is substantially the same as that during acceleration except for the difference of the direction of the control force. Therefore, during deceleration, the swinging motion of the bucket 6 is suppressed by stepwise deceleration of the trolley 3.

Although the position where the swinging motion of the bucket 6 is suppressed completely is desirable to be immediately above the transportation start position A and the transportation end position B, it is possible that the trolley 3 does not reach the target position or overruns the target position by effecting feedback control. In such case, the position may be corrected by fine adjustment after completion of control to lower the bucket 6 at the correct position to complete the transporting operation. For example, in case of loaded travel, on the basis of the detection values of the ultrasonic area sensors 50 and 78 provided on the bucket 6 and the hopper 11, fine adjustment of the position in the horizontal plane is performed for precisely aligning the bucket 6 to the hopper 11. Thereafter, the bucket 6 is stopped immediately above the hopper 11 and the gate is opened to discharge the concrete into the hopper 11 to complete all operations. Similarly, in case of return travel, after feedback control, the bucket 6 is positioned immediately above the banker line through fine adjustment. Then, the automatic fine adjustment for correcting the position in the horizontal plane is performed using the ultrasonic area sensors 50 and 44 on the bucket 6 and the banker line for bottoming the bucket on the banker line. The bottoming condition of the bucket 6 is detected by the switch 42. At this position, the bucket 6 becomes ready for receiving concrete.

Figure 19:
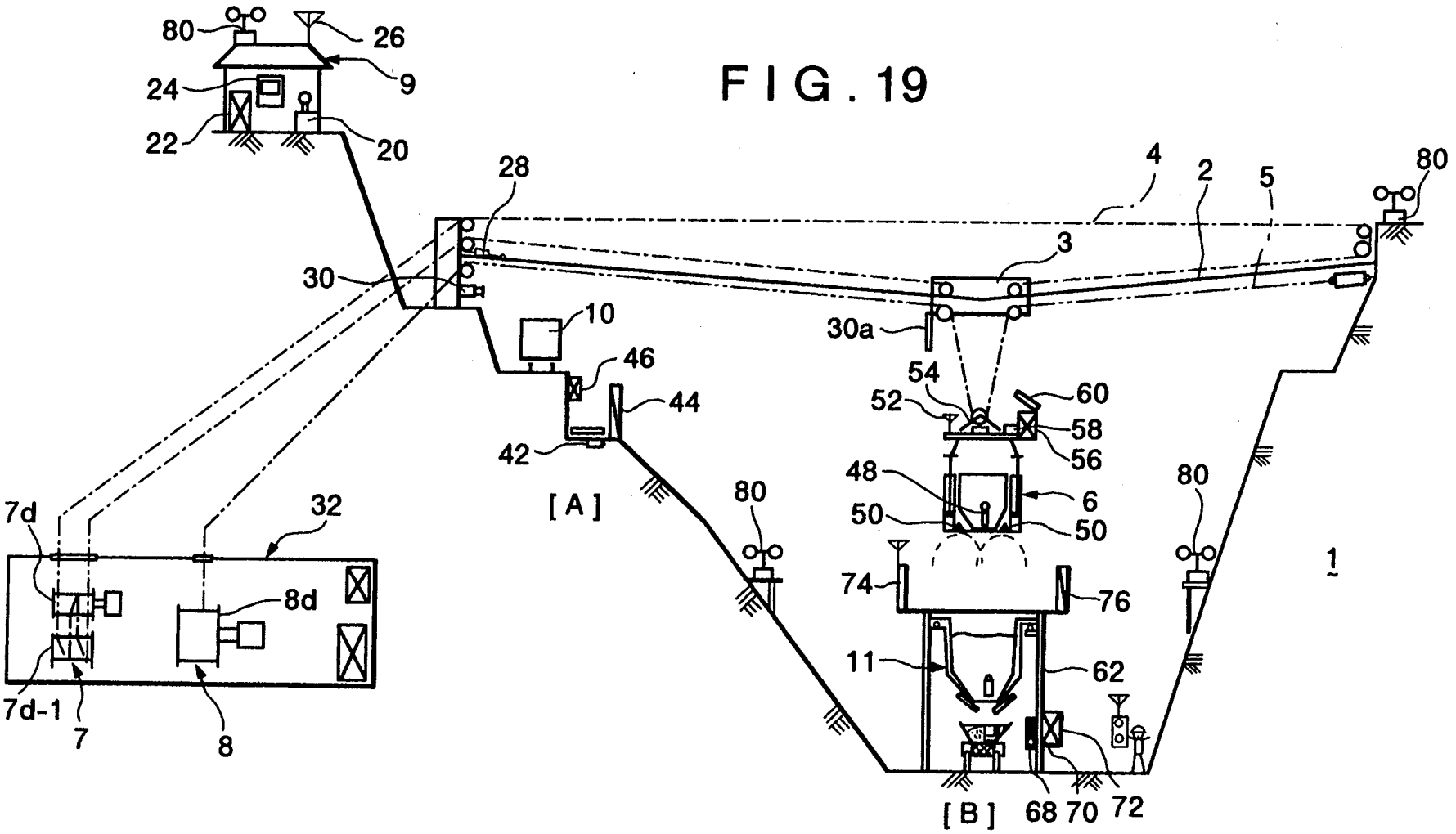
FIG. 19 is a diagrammatic illustration showing the overall construction of a fourth embodiment of the cable crane control system according to the invention.
Figure 20:
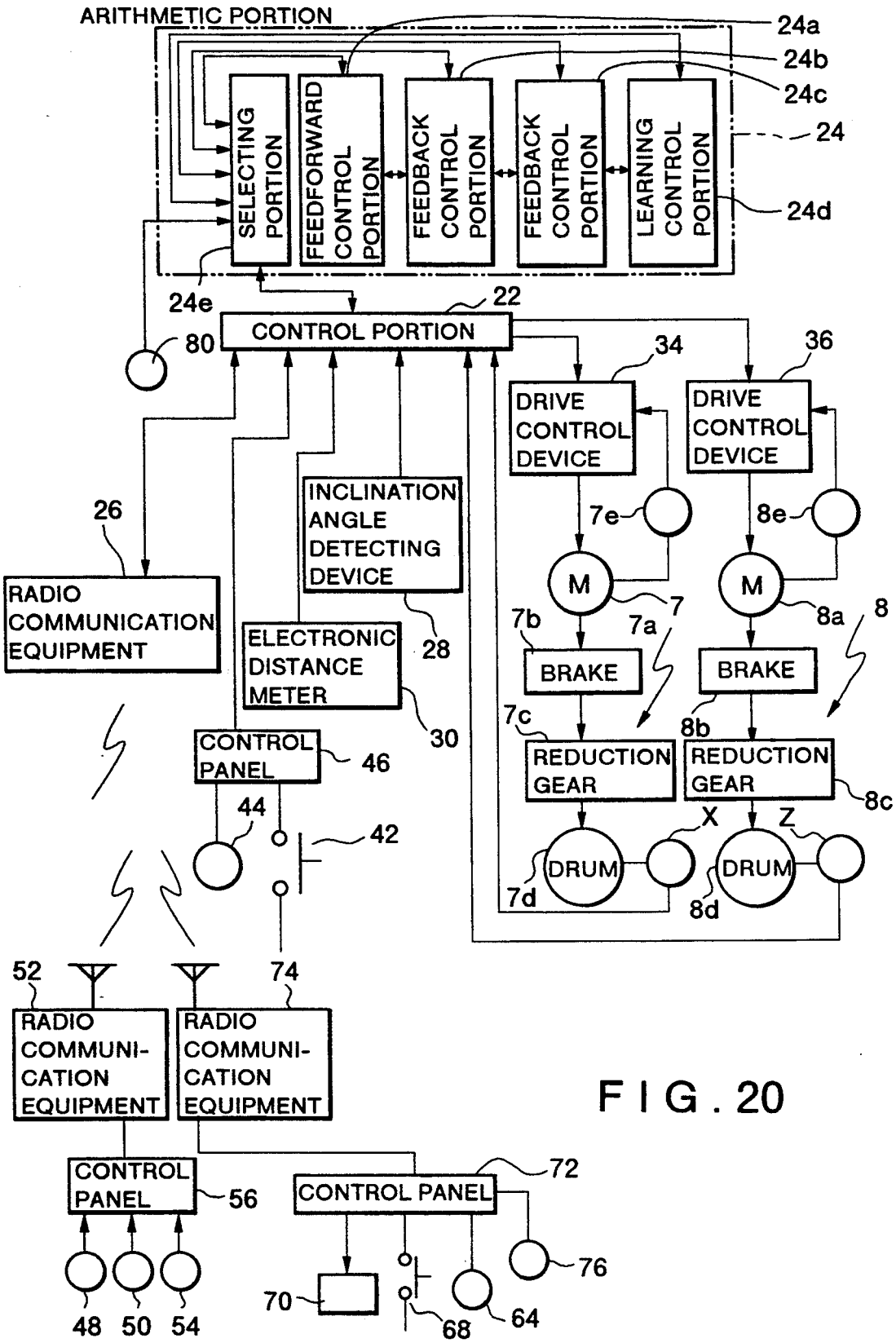
FIG. 20 is a block diagram showing construction of the fourth embodiment of the control system of the invention.

Next, discussion will be given of the fourth embodiment of the cable crane control system according to the present invention. In the fourth embodiment, the control processes of the foregoing first–third embodiments may be switched depending upon the operating condition. FIG. 19 is an explanatory illustration showing the construction of the system of this embodiment, and FIG. 20 is a functional block diagram of system of FIG. 19. Since the basic construction of this shown embodiment is substantially the same as those of the foregoing first—third embodiments, discussion will be given only of the points different from the former embodiments.

As shown in FIG. 19, meteorological observation devices 80 for monitoring wind velocity, wind direction and variation of wind direction are provided at a plurality of positions in the vicinity of this embodiment of the cable crane system. The meteorological observation devices 80 are connected to the arithmetic portion 24 through wired or radio communication systems or so forth for inputting data representative of wind velocity, wind direction and variation of wind direction varying from time to time to the arithmetic portion 24.

The arithmetic portion 24 includes five control systems, i.e.

(a) a feedforward control portion 24*a*, in which an optimal operation pattern on the basis of a path calculation is programmed;

(b) a feedback control portion 24*b*;

(c) a feedback control portion 24*c* for feedback control employing fuzzy inference;

(d) a learning control portion 24*d* for storing an optimal operation pattern by manual operation; and (e) a selecting portion 24*e* for selecting the control portions 24*a*–24*d* on the basis of predetermined conditions.

Next, detailed discussion is given for the content of control of the control portions 24*a*–24*d* and the selecting portion 24*e*.

(a) Feedforward Control Portion 24*a*

In the feedforward control portion 24*a* is stored a control program for providing operation patterns of the winches 7 and 8 to the control portion 22 of FIG. 20. The process of control to be performed by this control program is the same as that discussed in the first embodiment. Namely, at first, on the basis of an equation expressing a static equilibrium corresponding to the position of the trolley 3 on the main cable 2, and an equation for deriving a spring constant k of the main cable 2, a deflection model of the main cable 2 showing variation of a trace of the main cable 2 associated with the traveling motion of the trolley 3 is derived. Next, a coordinate representative of a predicted position of the bucket 6 corresponding to the deflection model of the main cable 2 is determined. Then, the extraction lengths of the traction cable 4 and the hanging cable are obtained a function of time.

(b) Feedback Control Portion 24*b*

The feedback control portion 24*b* of FIG. 20 calculates a feedback control amount and a control timing for canceling swinging motion of the bucket 6 corresponding to the swing angle and the angular velocity at a specific time during acceleration and deceleration to perform swing suppression control during acceleration and deceleration. The function is the same as that of the third embodiment.

(c) Feedback Control Portion 24*c* Employing Fuzzy Inference

The feedback control portion 24*c* of FIG. 20 stores a control program for providing operation patterns of the winches 7 and 8 to the control portion 22. The process of this control program is as follows. At first, on the basis of an equation expressing a static equilibrium corresponding to the position of the trolley 3 on the main cable 2, and an equation for deriving a spring constant k of the main cable 2, a deflection model of the main cable 2 showing variation of a trace of the main cable 2 associated with the traveling motion of the trolley 3 is derived. Next, a coordinate representative of a predicted position of the bucket 6 corresponding to the deflection model of the main cable 2 is determined. Then, the extraction lengths of the traction cable 4 and the hanging cable are obtained as a function of time. The control program is provided with a function for selecting a feedback magnitude to be provided via the operation control of the winches 7 and 8 for canceling swinging angle and swinging angular velocity of the bucket 6 through fuzzy inference. The content of control of this feedback control portion 24c is the same as that of the foregoing second embodiment.

(d) Learning Control Portion 24d

In the learning control portion, a plurality of past operation patterns performed through manual operation of the operators are stored together with data indicative of the weight of the bucket 6, operation period and so forth. The control portion 24d provides a control command to the control portion 22 by selectively reading out learned operation patterns for operating the bucket 6 substantially along the read out operation pattern.

(e) Selecting Portion 24e

The selecting portion 24e receives the results of meteorological observation from the meteorological observation devices 80 to perform judgements according to a predetermined rule, from time to time. Based on the result of judgements, the selecting portion 24e selects one of the control portions 24a–24d to be active for controlling the crane operation before initiation of operation. Hereinafter, concrete conditions for judgement by the selecting portion 24e will be discussed. At first, the advantages and drawbacks of respective of the control portions 24a–24d will be discussed.

The control system which can shorten the crane operation period to the maximum extent is the control system employed in the learning control portion 24d. Operation by qualified operators compromise a plurality of factors, such as working efficiency, control accuracy and safety at very high level. However, in practice, the weight of the bucket is variable at every transporting operation due to variation of the amount of concrete filled into the bucket 6, and the transportation end position B will be changed everyday. Thus manual operation by a qualified operator is required every time the transportation end position B is changed.

The control system which is less efficient than the learning control system 24d but can perform the transporting operation in a relatively short period, is the feedforward control system of the control portion 24a. In this case, even when there is a varying factor, such as the weight of the bucket, control can be performed through numerical calculation corresponding thereto. However, in this case, it is not possible to suppress swinging motion of the bucket due to influence of wind.

The control system which takes a relatively long period of time but which is relatively effective against the wind is the feedback control system employing fuzzy inference 24c. However, since this control system presets control ranges, it is not possible to perform control while taking into account variations of the wind occurring after presetting. Also, the operation period can be significantly expanded when the number of samples is increased for performing feedback control repeatedly.

The control system which is most certain in terms of suppression of swing motion of the bucket is the feedback control system of control portion 24b. Since the system performs feedback control repeatedly until the swinging motion of the bucket is completely stabilized irrespective of presence or absence of influence of the wind. However, since this system has a significant delay period from measurement of conditions necessary to actually perform control, it is difficult to improve efficiency. Also, at a certain wind velocity and strength of the wind, the crane operation may not be possible even with the control system of portion 24b.

The selecting portion 24e derives an average wind velocity for a period of ten minutes before initiation of a transporting operation. The wind velocity thus detected is arranged into four ranges, i.e. 0–2 (no wind), 2–4 (weak wind), 4–5 (slightly strong wind) and 5 or more (strong wind). Also, by monitoring the wind direction and variation of the wind direction, it is possible to judge the angle of intersection of the wind to the dam 1 so as to select the optimal control system depending upon the judged condition. Also, when judgement is made that transportation cannot be performed by any of the control systems, then judgement is made that the crane operation should be stopped.

Figure 21:
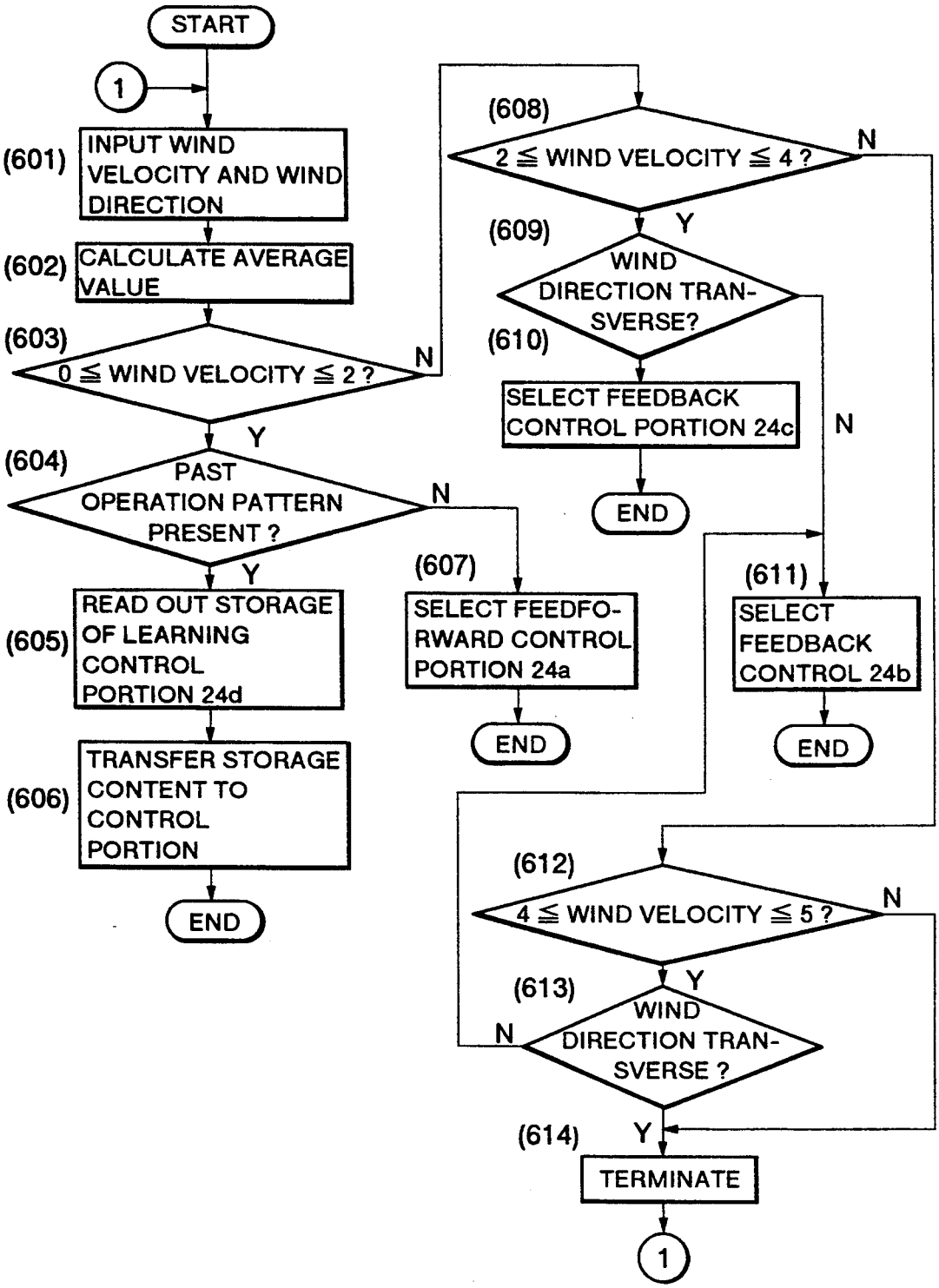
FIG. 21 is a flowchart showing a control process in the fourth embodiment of the invention.

FIG. 21 is a flowchart showing a process for judgement performed by the selecting portion 24e. As set forth above, the average value of the wind, and an average value of the wind direction for a 10 minute period before initiation of operation are calculated. If the wind velocity is 0–2, namely substantially in a no wind condition, then judgement is made of the learned operation pattern through manual operation with the minimum operation period under the same condition. If such control pattern is present, the learning control portion 24d is selected so that the bucket 6 can be operated according to the operation pattern read out from learning control portion 24d, via the control portion 22 (steps 601–606).

On the other hand, where there is no same pattern stored in the learning control portion 24d, the feedforward control portion 24a is selected to operate the bucket 6 according to the control program stored therein, via the control portion 22 (step 607).

When the wind velocity is 2–4, namely a weak wind, the wind direction is discriminated. If the wind direction is transverse to the longitudinal direction of the dam 1, the feedback control portion 24c employing fuzzy inference is selected to operate the bucket 6 according to the control program stored therein, via the control portion 22 (steps 608–610).

On the other hand, when the wind direction is not transverse to the longitudinal direction of the dam 1, the feedback control portion 24b is selected to operate the bucket 6 according to the control program stored therein, via the control portion 22 (step 611).

If the wind velocity is 4–5 and the wind direction is transverse to the longitudinal direction of the dam 1, termination of operation is determined. On the other hand, when the wind direction is intersecting to the longitudinal direction in a certain range, the feedback control portion 24b is selected (steps 613 and 614).

If the wind velocity is higher than or equal to 5, the operation is terminated. Then, by returning to the step 601, operation for calculating the average wind velocity and wind direction for the most recent 10 minutes is repeated so as to maintain the system in stand-by state until the content of calculations satisfies the conditions for selecting one of the control portions 24a–24d.

It should be noted that although selection of the control system in a simple process is discussed in FIG. 21, it may be possible to establish fuzzy inference in terms of the wind velocity, the wind direction and variation of the wind direction to select the control portions 24a–24d depending upon the results of inference.

Also, it is possible to establish a neural network with by taking into account the wind velocity within a predetermined period as input and selection of the control system as output to learn of past events (relationship between the inputs of the wind velocity and the wind direction and the output of the selected control system), so that one of the control portions 24a–24d can be selected based thereon.

Next, a monitoring system for the trolley and the bucket in the cable crane control system of the first to fourth embodiments will be discussed. In the foregoing embodiments, the coordinate positions of the trolley 3 and the bucket 6 are detected on the basis of the amount of extraction of the traction cable 4, the hanging cable 5 and/or by means of the electronic distance meter. The positions of the trolley 3 and the bucket 6 can also be derived by providing an image pick-up device, such as a monitor camera or so forth, and directly processing the image information picked up by such image pick-up device.

Figure 22:
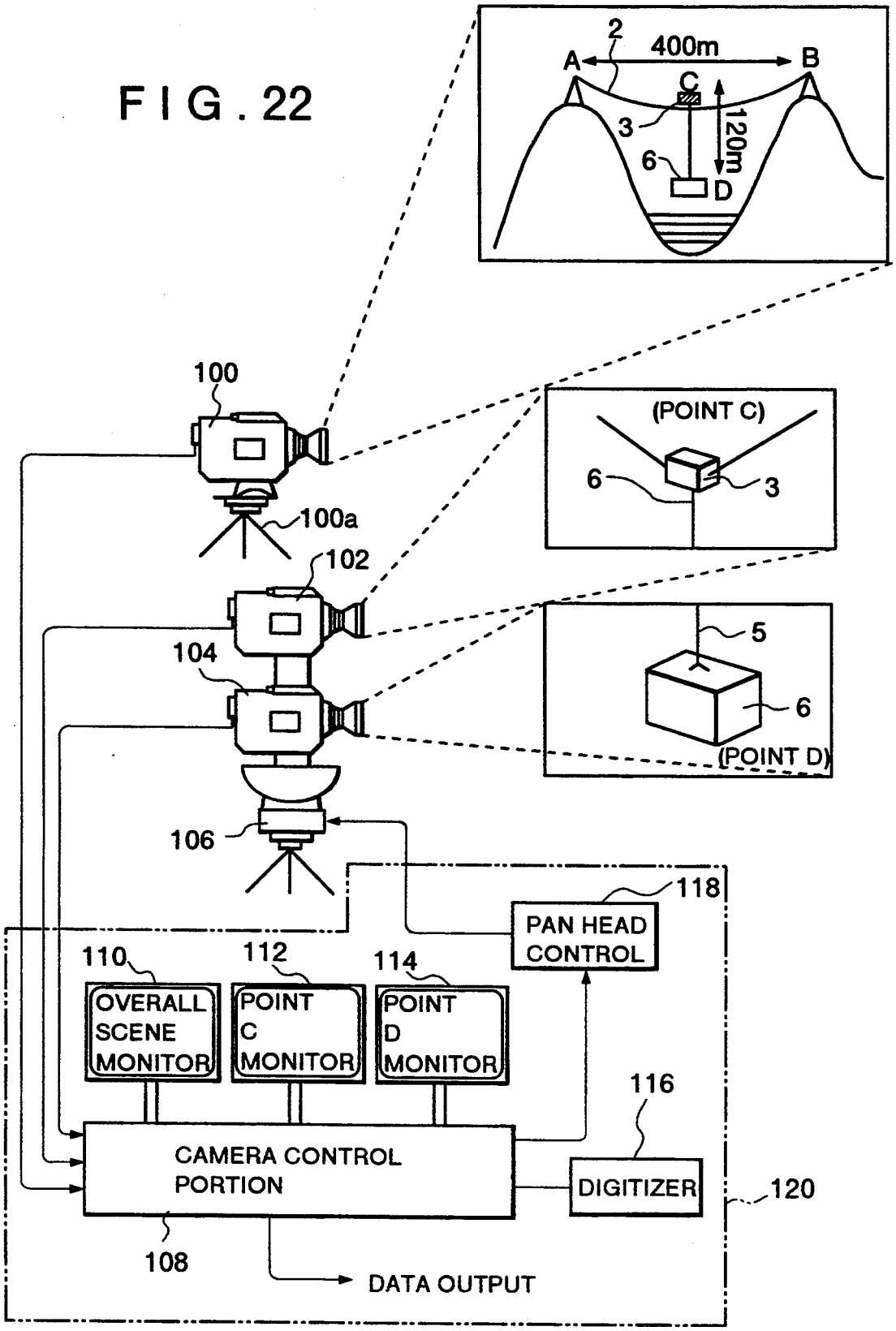
FIG. 22 is a diagrammatic illustration showing a construction of a monitoring system for the trolley and the bucket, applicable for the present invention.

Namely, in the cable crane system illustrated in FIG. 1, the motions of the trolley 3 and the bucket are monitored by three monitoring cameras 100, 102 and 104 as shown in FIG. 22. The first monitoring camera 100 is adapted to pickup the overall sight of the dam 1 including the cable crane. For example, when the distance between two stationary positions A and B of the main cable 2 is 400 m, the height from the hopper 11 positioned on the bottom of dam 1 to the center C of the main cable 2 is 120 m, the first monitoring camera is provided to include sight of this entire area. The first monitoring camera 100 is stationarily supported on a tripod or so forth for constantly picking up the image of the overall area. The second monitoring camera 102 is adapted to pick-up an image around a central stop position C of the trolley 3. On the other hand, the third monitoring camera 104 is adapted to pick-up an image of the bucket 6 at a lowered position D immediately above the hopper 11. The second and third monitoring cameras 102 and 104 are arranged at the same position relative to the first monitoring camera 100 and supported on a common pan head 106 in an adjustable manner. Magnifications of the second and third monitoring cameras 102 and 104 are selected to be approximately ten times the magnification of the first monitoring camera 100.

These monitoring cameras 100, 102 and 104 are connected to an overall sight monitoring display 110, a position C monitoring display 112 and a position D monitoring display 114 via a camera control portion 108 as a part of a calculating and detecting portion 120 arranged in the operation room 9.

In the camera control portion 108 are provided a digitizer 116 and a pan head control portion 118 for adjusting image pick-up reference points for the second and third monitoring cameras 102 and 104. By operating the digitizer 116, the pan head 106 is adjusted in vertical and transverse directions to position respective of the second and third monitoring cameras 102 and 104 at reference points. The reference points may be determined on the basis of the displacement of the positions C and D from the preceding day at the beginning of the daily operation. It should be noted that, in order to determine the reference points, high reflection markings or illuminates are provided on imaging surfaces of the trolley 3 and the bucket 6 for distinguishing from other scenes in the frame as external disturbance.

The monitoring cameras 100, 102 and 104 have pixels of 1512 (H)×1160 (V), and number of fields of 50 F/sec. The overall image size of the first monitoring camera 100 is 400 m×300 m. Therefore, the first monitoring camera 100 pick-up an image of 26.4 cm×25.9 cm per pixel. The position accuracy to be measured based on this screen is a maximum of 30 cm.

On the other hand, the second and third monitoring cameras 102 and 104 are provided with overall image size in the order of 3 m×3 m. Because of a narrow range of imaging, the position can be detected at much higher precision with the same number of pixels compared to the first monitoring camera. For example, when the trolley 3 or bucket 6 moves at a speed of 6 m/sec, it moves 12 cm per field, which corresponds to four pixels.

In the camera control portion 108 is a field memory for storing one field of information. Also, the camera control portion 108 is provided with a function of deriving the magnitude and speed of motion on the basis of a difference between the current field of image and the preceding field of image. The data thus derived is output to the control portion 22 for driving the winches 7 and 8, and used as data for feedforward and feedback control.

Figure 23:
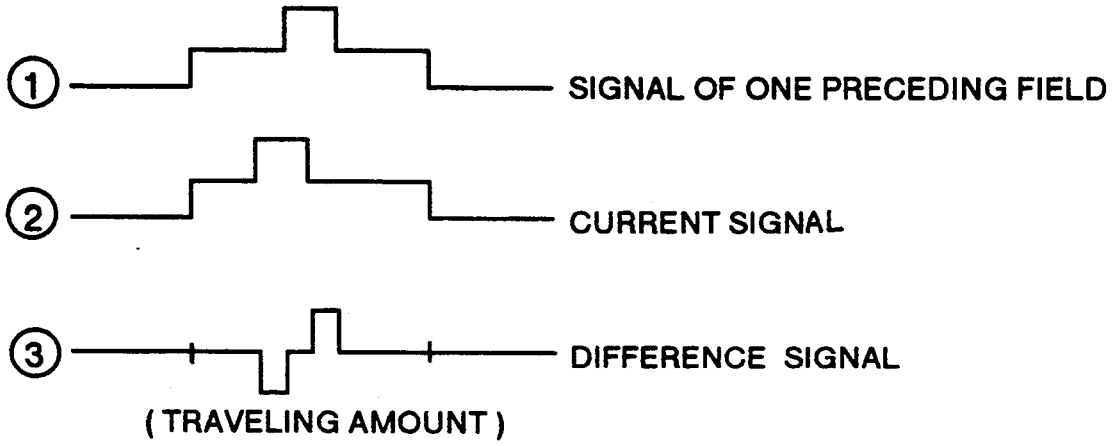
FIG. 23 is a graph showing a function of the monitoring system.

FIG. 23 is a timing chart. When the trolley 3 and the bucket 6 enter into the imaging range of the monitoring cameras 102 and 104, distance data in vertical and transverse directions from the reference points are output in the form of rectangular waves at a cycle of 1/50 sec. Accordingly, by sampling memory signals for each output, an error between the signal of a preceding field (1) and the signal of a current field (2) magnitudes of motion of each of the trolley and the bucket can be detected. Also, by dividing the magnitude of motion by time, the speed of motion in vertical and transverse directions can be detected.

Needless to say, auxiliary devices, such as lighting and so forth may be required when operation is continued in the dark. In such case, an amount of light sufficient for irradiating the overall site and sufficient for distinguishing the trolley and the bucket on the display screen are necessary.

It should be appreciated that although the above discussion involves monitoring motion and stopping of the trolley and the bucket at the center portion of the dam 1, the motion of the trolley and the bucket in the vicinity of the banker line may be monitored in the same manner.

Furthermore, by appropriate zooming the first monitoring camera 100 may be used as a replacement of one of the second and third monitoring camers 102 and 104.

Although the invention has been illustrated and described with respect to exemplary embodiments thereof, it should be understood by those skilled in the art that the foregoing and various other changes, omissions and additions may be made therein and thereto without departing from the spirit and scope of the present invention. Therefore, the present invention should not be understood as limited to the specific embodiments set out above but to include all possible embodiments which can be embodied within a scope encompassed and equivalents thereof with respect to the features set out in the appended claims.

What is claimed is:

1. In a cable crane system including: a main cable stretched between two points; a transverse trolley traveling along said main cable; a traction cable for driving said trolley; a bucket hung below said trolley via a hanging cable; a transverse winch for driving said traction cable for reciprocally driving said trolley between a transportation start position and a transportation end position; a vertical winch for retracting and extracting said hanging cable for lifting said bucket up and down; and driving means for said transverse and vertical winches, a control system for controlling said cable crane system, said control system comprising:

means for detecting a weight of an object for transportation including said trolley and said bucket;

means for detecting magnitude and speed of transverse travel of said trolley;

means for detecting magnitude and speed of vertical travel of said bucket;

arithmetic means for deriving a predicted value of a magnitude of deflection of said main cable on the basis of a trace of said main cable preliminarily established as a numerical model corresponding to the overall weight loaded on said main cable, detected by said weight detecting means, a coordinate of a starting point and target destination point of said trolley, and magnitude of transverse travel of said trolley and magnitude of vertical travel of said bucket; and means for controlling said driving means on the basis of results of arithmetic operation of said arithmetic means.

2. A cable crane control system as set forth in claim 1, wherein said weight detecting means includes an angle detecting means for detecting an angle formed by said main cable and a reference line.

3. A cable crane control system as set forth in claim 1, wherein said coordinate of said starting point of said trolley is detected by means of an electronic distance meter.

4. A cable crane control system as set forth in claim 1, wherein said arithmetic means comprises:

means for establishing a deflection model of said main cable according to travel of said trolley from a static equilibrium of said main cable corresponding to the position of said trolley relative to said main cable and an equation for deriving a spring constant of said main cable;

means for deriving a coordinate representative of a predicted position of said bucket corresponding to the deflection model of said main cable and extraction lengths of said traction cable and said hanging cable as functions of time;

means for dividing a range of motion of said bucket into a plurality of small blocks and outputting a control command for an operation pattern, in which said trolley and said bucket are accelerated from traveling speed zero then driven at a constant speed and decelerated so that the traveling speed becomes zero at a boundary of said small block for each said small blocks; and means, active during an acceleration period and a deceleration period of said operation pattern, for controlling variation of acceleration and deceleration of said trolley and said bucket at predetermined transition points of control on the basis of magnitudes and speeds of extraction of said traction cable and said hanging cable input from said means for detecting the magnitude and speed of transverse travel of said trolley and said means for detecting the magnitude and speed of vertical travel of said bucket.

5. In a cable crane system including: a main cable stretched between two points; a transverse trolley traveling along said main cable; a traction cable for driving said trolley; a bucket hung below said trolley via a hanging cable; a transverse winch for driving said traction cable for reciprocally driving said trolley between a transportation start position and a transportation end position; a vertical winch for retracting and extracting said hanging cable for lifting said bucket up and down; and driving means for said transverse and vertical winches, a control system for controlling said cable crane system, said control system comprising:

means for detecting a weight of an object for transportation including said trolley and said bucket;

means for detecting magnitude and speed of transverse travel of said trolley;

means for detecting magnitude and speed of vertical travel of said bucket;

means, provided on said bucket, for detecting an angle of swing of said bucket;

arithmetic means for deriving a predicted value of a magnitude of deflection of said main cable on the basis of a trace of said main cable preliminarily established as a numerical model corresponding to the overall weight loaded on said main cable, detected by said weight detecting means, a coordinate of a starting point and target destination point of said trolley, and magnitude of transverse travel of said trolley and magnitude of vertical travel of said bucket;

means for controlling said driving means on the basis of results of arithmetic operation of said arithmetic means according to a pattern of acceleration—constant speed traveling—deceleration—stopping; and feedback control means for applying a trolley speed detected by said trolley transverse travel magnitude and speed detecting means, a bucket swing angle and swing direction sequentially detected by said bucket vertical travel magnitude and speed detecting means and said swing angle detecting means, a magnitude of extraction of said traction cable detected by a traction cable extraction magnitude detecting means to a predetermined control rule for suppressing swinging motion of said bucket, and driving said driving means with a corrected prediction value corrected by said control rule as a control input.

6. A cable crane control system as set forth in claim 5, wherein said weight detecting means includes an angle detecting means for detecting an angle formed by said main cable and a reference line.

7. A cable crane control system as set forth in claim 5, wherein said coordinate of said starting point of said trolley is detected by means of an electronic distance meter.

8. A cable crane control system as set forth in claim 5, wherein said arithmetic means comprises:

means for establishing a deflection model of said main cable according to travel of said trolley from a static equilibrium of said main cable corresponding to the position of said trolley relative to said main cable and an equation for deriving a spring constant of said main cable;

means for deriving a coordinate representative of a predicted position of said bucket corresponding to the deflection model of said main cable and extraction lengths of said traction cable and said hanging cable as functions of time;

means for dividing a range of motion of said bucket into a plurality of small blocks and outputting a control command for an operation pattern, in which said trolley and said bucket are accelerated from traveling speed zero, then driven at a constant speed and decelerated so that the traveling speed becomes zero at a boundary of said small block for each of said small blocks; and means, active during an acceleration period and a deceleration period of said operation pattern, for controlling variation of acceleration and deceleration of said trolley and said bucket at predetermined transition points of control on the basis of magnitudes and speeds of extraction of said traction cable and said hanging cable input from said means for detecting the magnitude and speed of transverse travel of said trolley and said means for detecting the magnitude and speed of vertical travel of said bucket.

9. A cable crane control system as set forth in claim 5, wherein said control rule is applied for acceleration, deceleration and stopping of said trolley.

10. A cable crane control system as set forth in claim 9, wherein said control rule during acceleration of said trolley includes a rule for obtaining probabilities of respective membership functions with respect to actually measured values of the trolley speed, the bucket swing angle and swing direction, making inference of an amplitude of swing of said bucket on the basis of said probabilities, and making judgement for re-acceleration at a time when the swing amplitude through inference becomes less than or equal to a predetermined value for outputting an acceleration command to said feedback control means.

11. A cable crane control system as set forth in claim 9, wherein said control rule during deceleration of said trolley includes a rule for obtaining probabilities of respective membership functions with respect to actually measured values of the trolley speed, the bucket swing angle and swing direction, making inference of an amplitude of swing of said bucket after deceleration on the basis of said probabilities, and detecting a time when the swing amplitude through inference becomes less than or equal to a predetermined value, as a deceleration timing for outputting a deceleration command to said feedback control means.

12. A cable crane control system as set forth in claim 11, wherein said control rule during deceleration includes a rule for deriving probability with respect to a membership function for an actually measured value of said trolley speed, making an inference of offset of the actual decelerating position on the basis of such probability and deriving the bucket swing amplitude based on the value of said inference of offset of the deceleration position for reflecting said inference value on the value of said inference of swing amplitude.

13. A cable crane control system as set forth in claim 9, wherein said control rule upon stopping of said trolley includes a rule for obtaining probabilities of respective membership functions with respect to actually measured values of the trolley speed, the bucket swing angle and swing direction and magnitude of extraction of said traction cable, making inference of an amplitude of swing of said bucket after deceleration on the basis of said probabilities, and detecting a time when the swing amplitude through inference becomes less than or equal to a predetermined value, as a deceleration timing for outputting a deceleration command to said feedback control means for stopping.

14. A cable crane control system as set forth in claim 11, wherein said control rule upon stopping includes a rule for deriving probability with respect to a membership function for an actually measured value of said trolley speed, making an inference of offset of the stop position on the basis of such probability and detecting a time, at which the value of said inference of said offset of said stop position becomes less than or equal to a predetermined value, as a deceleration time for outputting the deceleration command for stopping to said feedback control means.

15. In a cable crane system comprising: a main cable stretched between two points; a transverse trolley traveling along said main cable; a traction cable for driving said trolley; a bucket hung below said trolley via a hanging cable; a transverse wince for driving said traction cable for reciprocally driving said trolley between a transportation start position and a transportation end position; a vertical winch for retracting and extracting said hanging cable for lifting said bucket up and down; and driving means for said transverse and vertical winches, a control system for controlling said cable crane system, said control system comprising:

means for detecting a weight of an object for transportation including said trolley and said bucket;

means for detecting magnitude and speed of transverse travel of said trolley;

means for detecting magnitude and speed of vertical travel of said bucket;

means, provided on said bucket, for detecting an angle of swing of said bucket;

arithmetic means for deriving a predicted value of a magnitude of deflection of said main cable on the basis of a trace of said main cable preliminarily established as a numerical model corresponding to the overall weight loaded on said main cable, detected by said weight detecting means, a coordinate of a starting point and target destination point of said trolley, and magnitude of transverse travel of said trolley and magnitude of vertical travel of said bucket;

means for controlling said driving means on the basis of results of arithmetic operation of said arithmetic means; and feedback control means for setting a magnitude of deceleration or acceleration and a control time for canceling swinging of said bucket on the basis of the swing angle and angular velocity of said bucket detected by said bucket swing angle detecting means and driving said driving means based on such set values.

16. A cable crane control system as set forth in claim 15, wherein said weight detecting means includes an angle detecting means for detecting an angle formed by said main cable and a reference line.

17. A cable crane control system as set forth in claim 15, wherein said coordinate of said starting point of said trolley is detected by means of an electronic distance meter.

18. A cable crane control system as set forth in claim 15, wherein said arithmetic means comprises:

means for establishing a deflection model of said main cable according to travel of said trolley from a static equilibrium of said main cable corresponding to the position of said trolley relative to said main cable and an equation for deriving a spring constant of said main cable;

means for deriving a coordinate representative of a predicted position of said bucket corresponding to the deflection model of said main cable and extraction lengths of said traction cable and said hanging cable as functions of time;

means for dividing a range of motion of said bucket into a plurality of small blocks and outputting a control command for an operation pattern, in which said trolley and said bucket are accelerated from traveling speed zero, then driven at a constant speed and decelerated so that the traveling speed becomes zero at a boundary of said block for each of said small blocks; and means, active during an acceleration period and a deceleration period of said operation pattern, for controlling variation of acceleration and deceleration of said trolley and said bucket at predetermined transition points of control on the basis of magnitudes and speeds of extraction of said traction cable and said hanging cable input from said means for detecting the magnitude and speed of transverse travel of said trolley and said means for detecting the magnitude and speed of vertical travel of said bucket.

19. A cable crane control system as set forth in claim 15, wherein said feedback control means includes means for accelerating said trolley for a given period, measuring a swing angle and an angular velocity of swinging of said bucket at a time of termination of acceleration, deriving a timing of amplitude of swinging motion of said bucket after termination of acceleration, and outputting an acceleration command for accelerating said trolley so that the amplitude of swinging motion of said bucket at said derived timing becomes minimum.

20. A cable crane control system as set forth in claim 15, which further comprises a second feedback means, active when the swing angle and the angular velocity of said bucket detected by said swing angle detecting means after control of said feedback means exceeds allowable values, for re-setting a magnitude of deceleration or acceleration and control timing for canceling swing and controlling said driving means on the basis of such re-set values.

21. In a cable crane system including: a main cable stretched between two points; a transverse trolley traveling along said main cable; a traction cable for driving said trolley; a bucket hung below said trolley via a hanging cable; a transverse winch for driving said traction cable for reciprocally driving said trolley between a transportation start position and a transportation end position; a vertical winch for retracting and extracting said hanging cable for lifting said bucket up and down; and driving means for said transverse and vertical winches, a control system for controlling said cable crane system, said control system comprising:

means for detecting a weight of an object for transportation including said trolley and said bucket;

means for detecting magnitude and speed of transverse travel of said trolley;

means for detecting magnitude and speed of vertical travel of said bucket;

means, provided on said bucket, for detecting an angle of swing of said bucket;

arithmetic means for deriving a predicted value of a magnitude of deflection of said main cable on the basis of a trace of said main cable preliminarily established as a numerical model corresponding to the overall weight loaded on said main cable, detected by said weight detecting means, a coordinate of a starting point and target destination point of said trolley, and magnitude of transverse travel of said trolley and magnitude of vertical travel of said bucket;

first control means for controlling said driving means on the basis of results of arithmetic operation of said arithmetic means;

second control means for setting values of a magnitude of deceleration or acceleration and a control time for canceling swinging of said bucket on the basis of said angle of swing and angular velocity of the bucket detected by said bucket swing angle detecting means and outputting feedback control information based on such set values;

third control means for applying the trolley speed detected by said trolley transverse travel magnitude and speed detecting means, a bucket swing angle and swing direction sequentially detected by said bucket vertical travel magnitude and speed detecting means and said swing angle detecting means, a magnitude of extraction of said traction cable detected by traction cable extraction magnitude detecting means to a predetermined control rule for suppressing swinging motion of said bucket, and outputting a corrected prediction value corrected by said control rule as feedback control information;

fourth control means for storing a driving process of said driving means by manual operation and outputting an operation pattern on the basis of the stored content;

selecting means for selecting one of said first to fourth control means according to a predetermined control rule in terms of an external variable factor; and drive control means for operating said driving means for respective said winches from starting according to a control pattern based on control information provided from said one of said first to fourth control means selected by said selecting means.

22. A cable crane control system as set forth in claim 21, wherein said weight detecting means includes an angle detecting means for detecting an angle formed by said main cable and a reference line.

23. A cable crane control system as set forth in claim 21, wherein said coordinate of said starting point of said trolley is detected by means of an electronic distance meter.

24. A cable crane control system as set forth in claim 21, wherein said arithmetic means comprises:

means for establishing a deflection model of said main cable according to travel of said trolley from a static equilibrium of said main cable corresponding to the position of said trolley relative to said main cable and an equation for deriving a spring constant of said main cable;

means for deriving a coordinate representative of a predicted position of said bucket corresponding to the deflection model of said main cable and extraction lengths of said traction cable and said hanging cable as functions of time;

means for dividing a range of motion of said bucket into a plurality of small blocks and outputting a control command for an operation pattern, in which said trolley and said bucket are accelerated from traveling speed zero, then driven at a constant speed and decelerated so that the traveling speed becomes zero at a boundary of said small block for each of said small block; and means, active during an acceleration period and a deceleration period of said operation pattern, for controlling variation of acceleration and deceleration of said trolley and said bucket at predetermined transition points of control on the basis of magnitudes and speeds of extraction of said traction cable and said hanging cable input from said means for detecting the magnitude and speed of transverse travel of said trolley and means for detecting the magnitude and speed of vertical travel of said bucket.

25. A cable crane control system as set forth in claim 21, wherein said first control means outputs a control command value for said drive control means so that said trolley is accelerated and decelerated according to an operation pattern provided by said arithmetic means.

26. A cable crane control system as set forth in claim 21, wherein said second control means includes means for accelerating said trolley for a given period, measuring a swing angle and an angular velocity of swinging of said bucket at a time of termination of acceleration deriving a timing of amplitude of swinging motion of said bucket after termination of acceleration, and outputting an acceleration command for accelerating said trolley so that the amplitude of swinging motion of said bucket at said derived timing becomes minimum.

27. A cable crane control system as set forth in claim 26, wherein said second control means comprises a feedback control means active when the swing angle and the angular velocity of said bucket detected by said swing angle detecting means after control of said feedback means exceeds allowable values, for re-setting a magnitude of deceleration or acceleration and control timing for canceling swing and controlling said driving means on the basis of such re-set values.

28. A cable crane control system as set forth in claim 21, wherein the control rule contained in said third control means is applicable during acceleration, deceleration and upon stopping of said trolley.

29. A cable crane control system as set forth in claim 28, wherein said control rule during acceleration of said trolley includes a rule for obtaining probabilities of respective membership functions with respect to actually measured values of the trolley speed, the bucket swing angle and swing direction, making inference of an amplitude of swing of said bucket on the basis of said probabilities, and making judgement for re-acceleration at a time when the swing amplitude through inference becomes less than or equal to a predetermined value for outputting an acceleration command to said third control means.

30. A cable crane control system as set forth in claim 28, wherein said control rule during deceleration of said trolley includes a rule for obtaining probabilities of respective membership functions with respect to actu- swing angle and swing direction, making inference of an ally measured values of the trolley speed, the bucket amplitude of swing of said bucket after deceleration on the basis of said probabilities, and detecting a time when the swing amplitude through inference becomes less than or equal to a predetermined value, as a deceleration timing for outputting a deceleration command to said third control means.

31. A cable crane control system as set forth in claim 30, wherein said control rule during deceleration includes a rule for deriving probability with respect to a membership function of an actually measured value of said trolley speed, making an inference of offset of the actual decelerating position on the basis of such probability and deriving the bucket swing amplitude based on the value of said inference of offset of the deceleration position for reflecting said inference value on the value of said inference of swing amplitude.

32. A cable crane control system as set forth in claim 28, wherein said control rule upon stopping of said trolley includes a rule for obtaining probabilities of respective membership functions with respect to actually measured values of the trolley speed, the bucket swing angle and swing direction and magnitude of extraction of said traction cable, making inference of an amplitude of swing of said bucket after deceleration on the basis of said probabilities, and detecting a time when the swing amplitude through inference becomes less than or equal to a predetermined value, as a deceleration timing for outputting a deceleration command to said third control means for stopping.

33. A cable crane control system as set forth in claim 28, wherein said control rule upon stopping includes a rule for deriving probability with respect to a membership function for an actually measured value of said trolley speed, making an inference of offset of the stop position on the basis of such probability and detecting a time, at which the value of said inference of said offset of said stop position becomes less than or equal to a predetermined value, as a deceleration time for outputting the deceleration command for stopping to said third control means.

34. A cable crane control system as set forth in claim 21, wherein said selecting means receives information of wind velocity, wind direction and variation of the wind direction sampled by meteorological equipment positioned at a plurality of positions in said vicinity of the cable crane system, and selects one of said first to fourth control means or commands termination of operation by applying the received information to said control rule.

35. In a cable crane system including: a main cable stretched between two points; a transverse trolley traveling along said main cable; a traction cable for driving said trolley; a bucket hung below said trolley via a hanging cable; a transverse winch for driving said traction cable for reciprocally driving said trolley between a transportation start position and a transportation end position; a vertical winch for retracting and extracting said hanging cable for lifting said bucket up and down; and driving means for said transverse and vertical winches, a cable crane monitoring system comprising:

first image pick-up means for picking-up an image of an overall scene, said first image pick-up means having an imaging range covering an overall region in which said bucket of said cable crane system travels;

second image pick-up means for picking-up a scene of an imaging region at a trolley stopping means;

third image pick-up means for picking-up a scene of an imaging region; and an arithmetic means connected to respective said image pick-up means for performing arithmetic operations for extracting position information and speed information of an imaging object on the basis of image information from respective of said image pick-up means.

* * * * *